US009574371B2

(12) United States Patent
English

(10) Patent No.: US 9,574,371 B2
(45) Date of Patent: Feb. 21, 2017

(54) DISPLAY ASSEMBLY AS A DOOR HANDLE IN AN OEM FACTORY CONSTRUCTION

(71) Applicant: Wild August LLC, Chicago, IL (US)

(72) Inventor: Larry English, Chicago, IL (US)

(73) Assignee: Wild August LLC, Chicago, IL (US)

( * ) Notice: Subject to any disclaimer, the term of this patent is extended or adjusted under 35 U.S.C. 154(b) by 0 days.

(21) Appl. No.: 14/710,233

(22) Filed: May 12, 2015

(65) Prior Publication Data

US 2016/0305155 A1 Oct. 20, 2016

Related U.S. Application Data

(63) Continuation-in-part of application No. 14/690,271, filed on Apr. 17, 2015.

(51) Int. Cl.
*E05B 1/00* (2006.01)

(52) U.S. Cl.
CPC ..... *E05B 1/0084* (2013.01); *E05B 1/0015* (2013.01)

(58) Field of Classification Search
CPC ..... E05B 1/0084; E05B 1/0015; G08B 21/18; H03K 17/945; H05K 5/0017; H05K 5/0204
See application file for complete search history.

(56) References Cited

U.S. PATENT DOCUMENTS

| | | | | |
|---|---|---|---|---|
| 9,200,771 | B2 * | 12/2015 | Brennan | F21S 9/02 |
| 2006/0012189 | A1 * | 1/2006 | Olivier | E05B 1/0015 292/336.3 |
| 2012/0105424 | A1 * | 5/2012 | Lee | G09F 9/35 345/212 |
| 2012/0159826 | A1 * | 6/2012 | Eichner | G09F 7/18 40/779 |
| 2014/0137449 | A1 * | 5/2014 | English | F16B 2/20 40/599 |
| 2016/0222703 | A1 * | 8/2016 | Koizumi | E05B 81/77 |

* cited by examiner

*Primary Examiner* — Hirdepal Singh
(74) *Attorney, Agent, or Firm* — Flachsbart & Greenspoon LLC

(57) ABSTRACT

Four embodiments of a novel display assembly as a door handle are described. The first embodiment is used with a cable conduit and associated electrical wire, and comprises an outrigger and a handle having a display accessory. The second embodiment does not require an electrical wire. Like the first embodiment, the second embodiment comprises an outrigger and a handle having a display accessory. The third embodiment uses an inset handle for opening and a flat surface for a sticker advertisement with no cover. The fourth embodiment is a display case door handle accessory with a recessed panel for holding advertising material. Finally, a method is described for performing a retrofit install of the first and second embodiments.

12 Claims, 58 Drawing Sheets

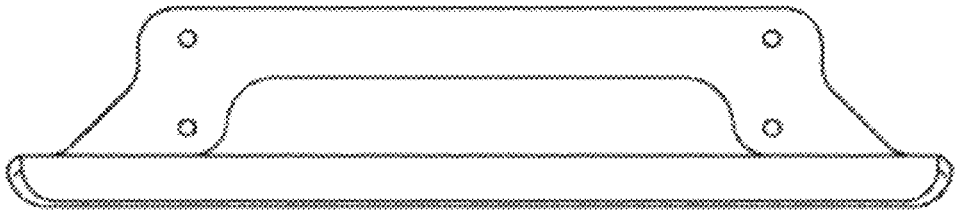
FIG. 46
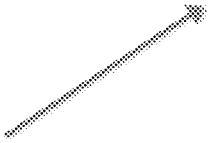
700

DISPLAY ASSEMBLY AS A DOOR HANDLE IN AN OEM FACTORY CONSTRUCTION

This application is a continuation-in-part of U.S. patent application Ser. No. 14/690,271, filed Apr. 17, 2015. This application hereby incorporates by reference U.S. patent application Ser. No. 14/690,271 in its entirety.

TECHNICAL FIELD OF THE INVENTION

The present invention relates generally to display advertising surfaces, and more specifically to door handle assemblies that are originally manufactured as a factory install.

BACKGROUND OF THE INVENTION

U.S. patent application Ser. No. 13/540,534 to Larry English, which applicant hereby incorporates by reference, describes a display assembly that does not require replacement of a cooler door handle. As described, the display assembly allows advertisements to receive consumer attention at or near the moment of purchase, and allows for quick and easy advertisement changes. The invention of the '534 application overcomes the prior art in part because it enables the display assembly to be installed on a wide variety of existing legacy cooler door handles, rather that it being an Original Equipment Manufacturer (OEM) part or a full handle replacement. However, it would be advantageous to have an OEM display assembly door handle that can include features and conveniences not possible in a legacy-handle accessory. Another application, namely U.S. patent application Ser. No. 13/570,011, hereby incorporated by reference, describes a door handle display assembly capable of generating multisensory stimuli when a person approaches the handle. For example, it describes a motion or proximity sensing device, physically coupled to the surface of the display assembly, and at least one lighting device electrically coupled to the motion or proximity sensing device. The present invention advantageously incorporates these features while being an OEM factory door handle installation, which allows for synergies not possible to realize in the '011 embodiments.

As one example, an OEM factory install display assembly door handle is designed to interoperate with a cooler's electrical system. It is able to be used with modules for lighting, audio, scent, as well as paper ads or for product pricing communication.

U.S. Pat. No. 7,383,654 to Olivier et al. ("Olivier") describes an apparatus and method for providing a door handle adapted to receive interchangeable display inserts. Olivier describes a handle body having a securable portion and graspable portion, together with a support surface for receiving a display insert. However, Olivier does not describe placement of a display surface as a door handle in an OEM factory construction with a cable chase or conduit, specifically designed to interoperate with a cooler's electrical system, constructed with attachment standoffs as will be described below.

SUMMARY OF THE INVENTION

This invention is an OEM factory construction door handle comprising a display advertisement insert, though the teachings herein may apply equally to retrofits. The door handle is designed to interoperate with a cooler's electrical system. The handle can be used with modules for lighting, audio, scent, as well as paper ads or for product pricing communication. It comprises a display assembly, a handle foundation, and standoffs (of different shapes, preferably either oval or diamond) having mounting holes and a center hole hollow core, through which electrical wiring passes from the cooler all the way to the handle itself. The display assembly comprises a convexly curved surface. When one of the display assembly's end caps is removed (e.g., the top), a display ad and its optional clear flexible cover are inserted. Because the advertisement is at the handle, a customer's attention is easily drawn to the ad. The invention can be used with any type of storage unit, not just for doors of refrigerated coolers or freezers.

BRIEF DESCRIPTION OF THE DRAWINGS

FIG. 46 is a view of one side of the display case door handle accessory shown in FIGS. 41 and 42.

DETAILED DESCRIPTION OF INVENTION

Figure 1:
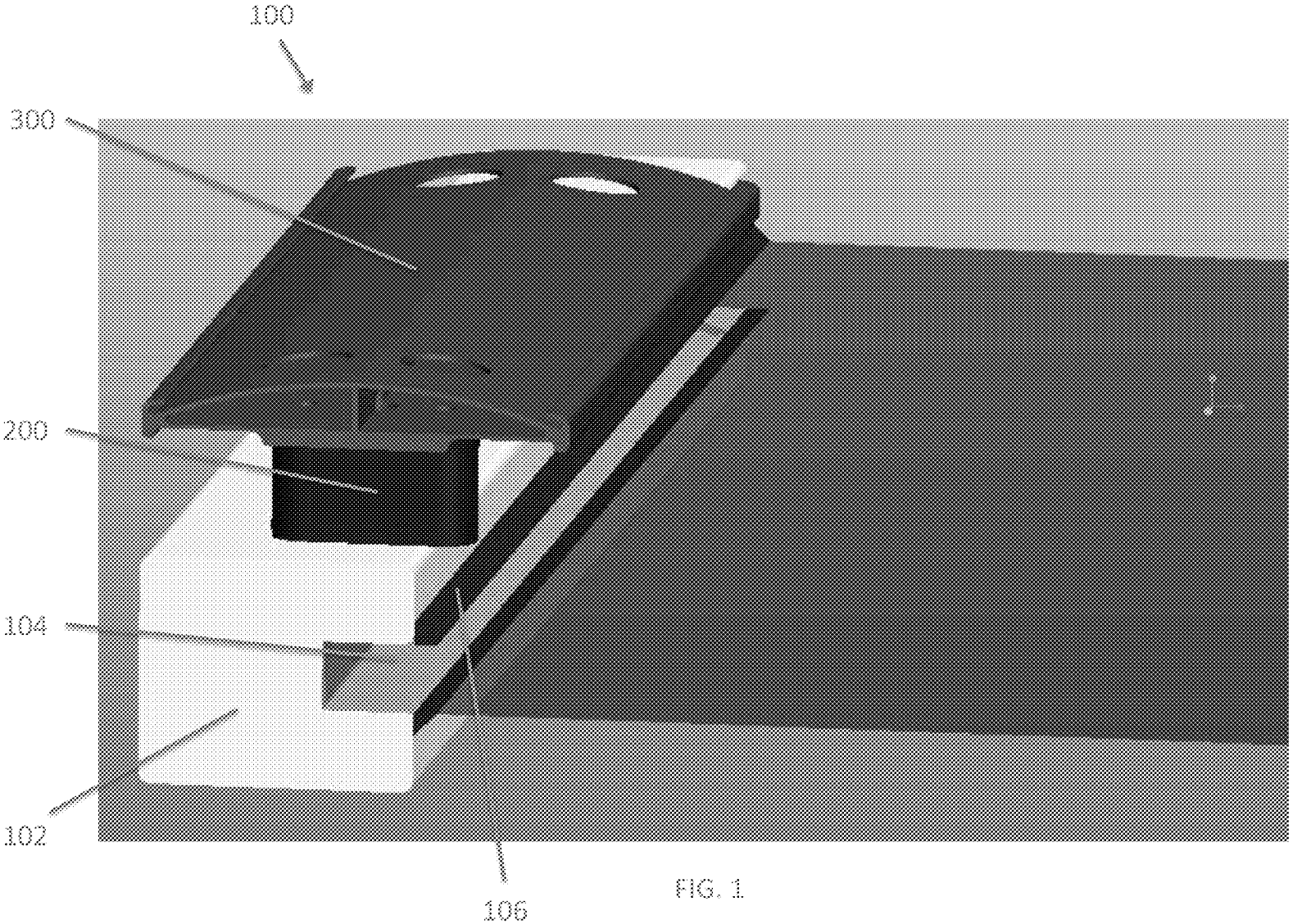
FIG. 1 is an installed factory OEM door handle assembly.
Figure 2:
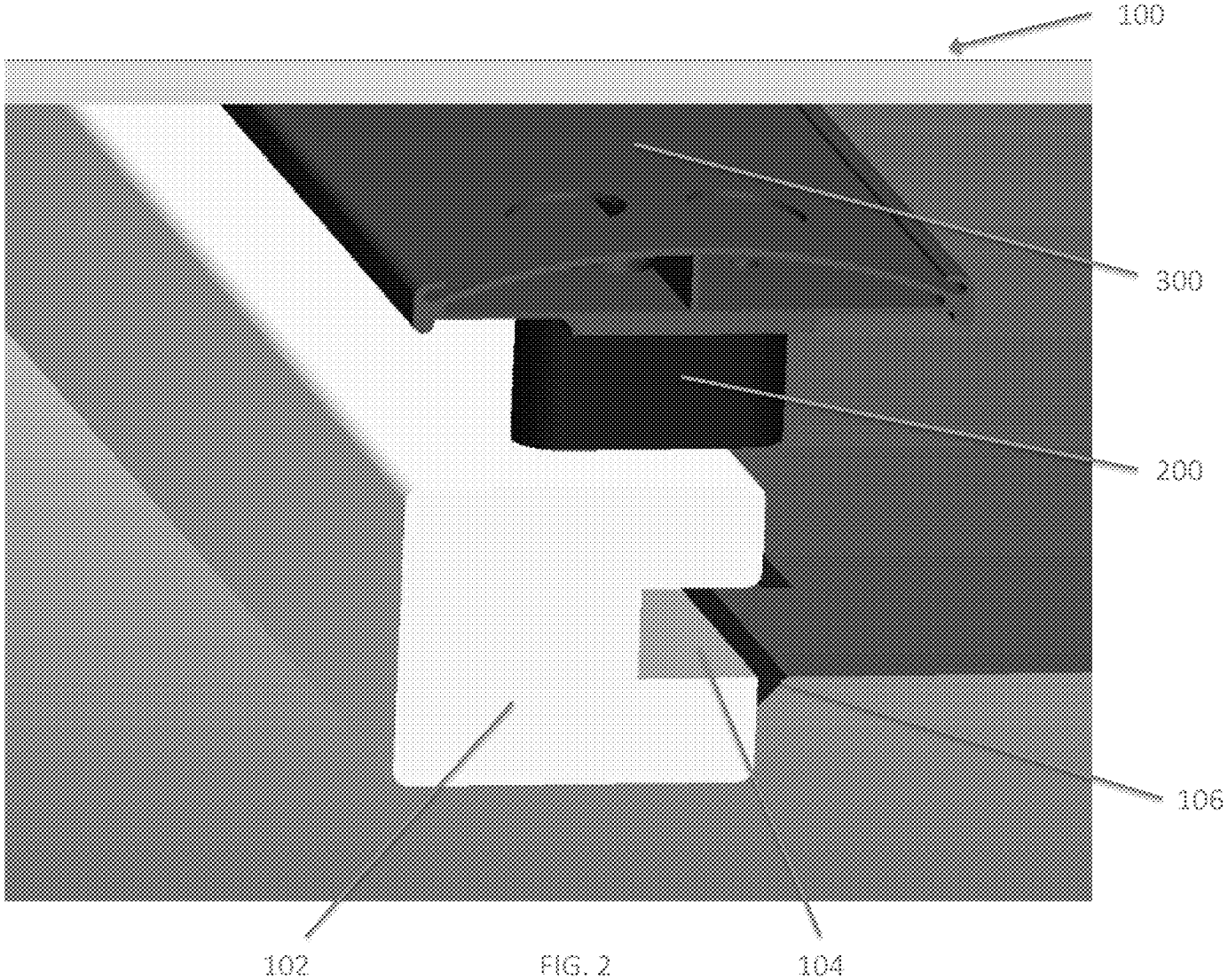
FIG. 2 is a close-up view of an installed OEM door handle assembly.

FIG. 1 shows a representative fully constructed OEM factory install door handle display assembly 100. It comprises a display assembly 300 to receive an advertisement insert, and an oval shaped standoff 200, which facilitates the attachment of the display assembly 300 to the door handle 102. The door handle 102 itself comprises a canal 104 to accommodate the door, and a fastener 106 to allow a secure connection between the door handle 104 and the door. The OEM factory install assembly 100 is designed to interoperate with the cooler door's electrical system. A transformer (not shown) resides within the cooler, and wiring is passed through the door and door handle through the standoff 200 and into the display assembly 300. This allows it to be used with modules for lighting, audio, scent, as well as paper ads or for product pricing communication (instead of little price tags in coolers). Therefore the assembly 100 acts as a cable conduit. FIG. 2 is a close-up view of the OEM factory install door handle display assembly 100.

Figure 3:
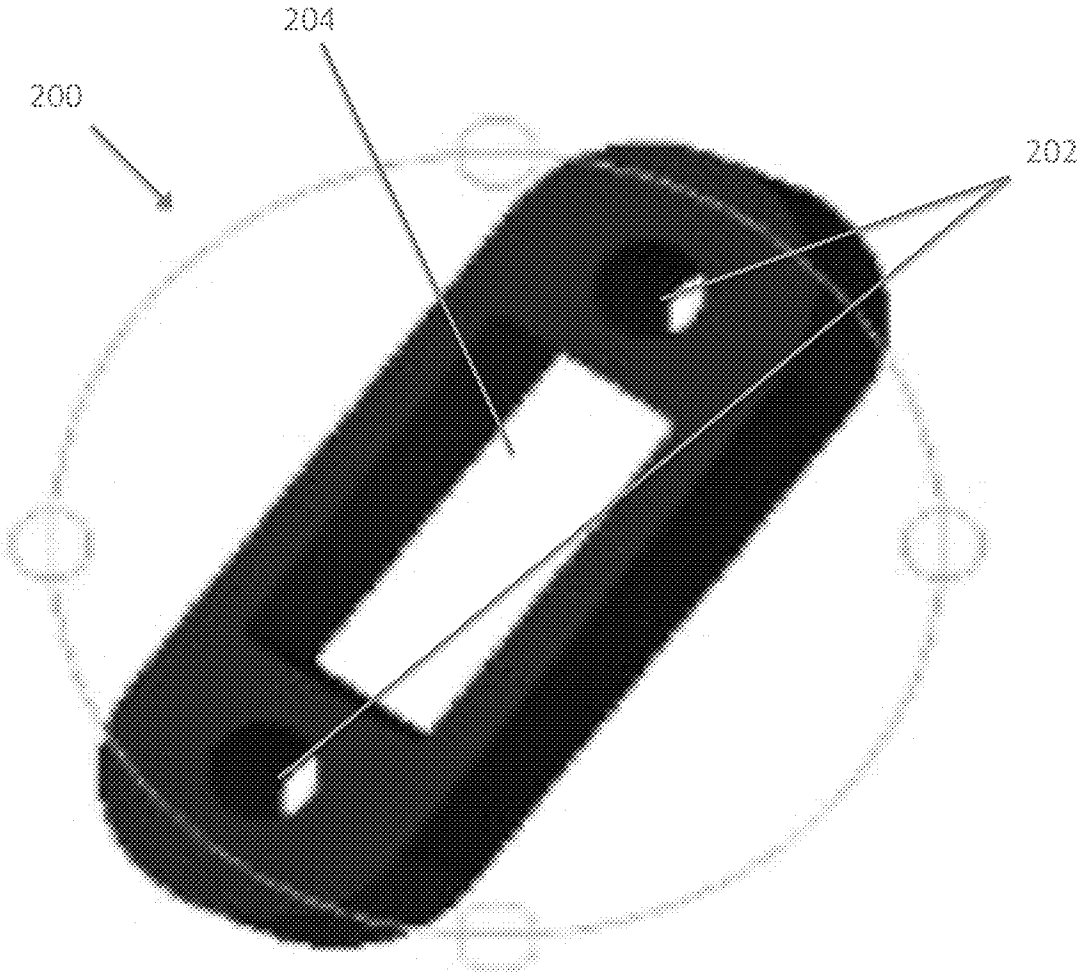
FIG. 3 is an oval/racetrack shaped standoff.

FIG. 3 shows a close-up view of an oval/racetrack shaped standoff 200 used in the constructions of FIGS. 1 and 2. It consists of mounting holes 202 and a center hole hollow core 204. This standoff 200 is preferably either an aluminum extrusion or a polymer casting molding. The standoffs 200 allow the wiring from a cooler to go through the center of the door handle and corresponding display assembly, via the standoff's center hole hollow core 204. The standoffs are connected to a cooler door from its handle through the small mounting holes 202 in the standoff and into inserts in the cooler door or from the back of a cooler door, through the standoffs and into female threaded inserts in a door handle. Wiring is then passed through the large center hole hollow core 204 from the cooler into the handle, then just below the module where all final connections are accomplished. That is, the center hole hollow core 204 to this standoff 200 allow the cable/wire to pass through from the exterior of the door to the center of the standoff, through a hole into the cavity of the handle, and up to the electronic endcap, on the right side.

Figure 4:
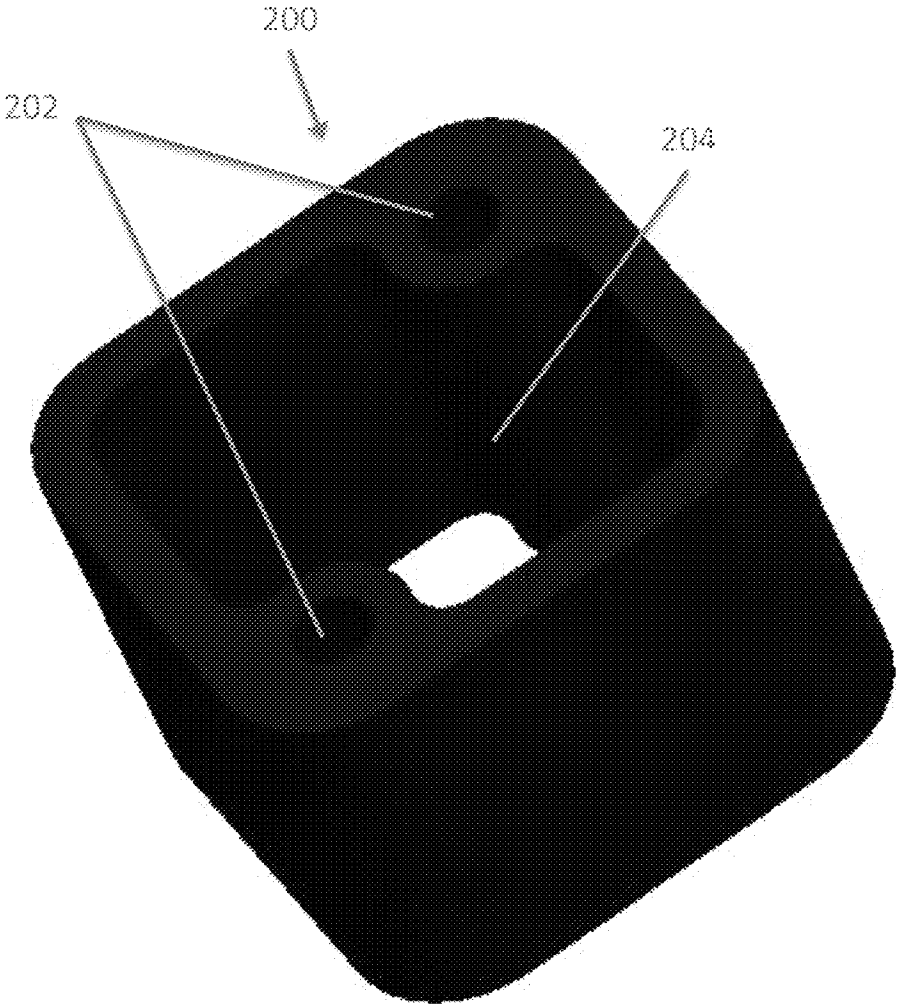
FIG. 4 is a perspective view of a broader diamond shaped standoff.
Figure 5:
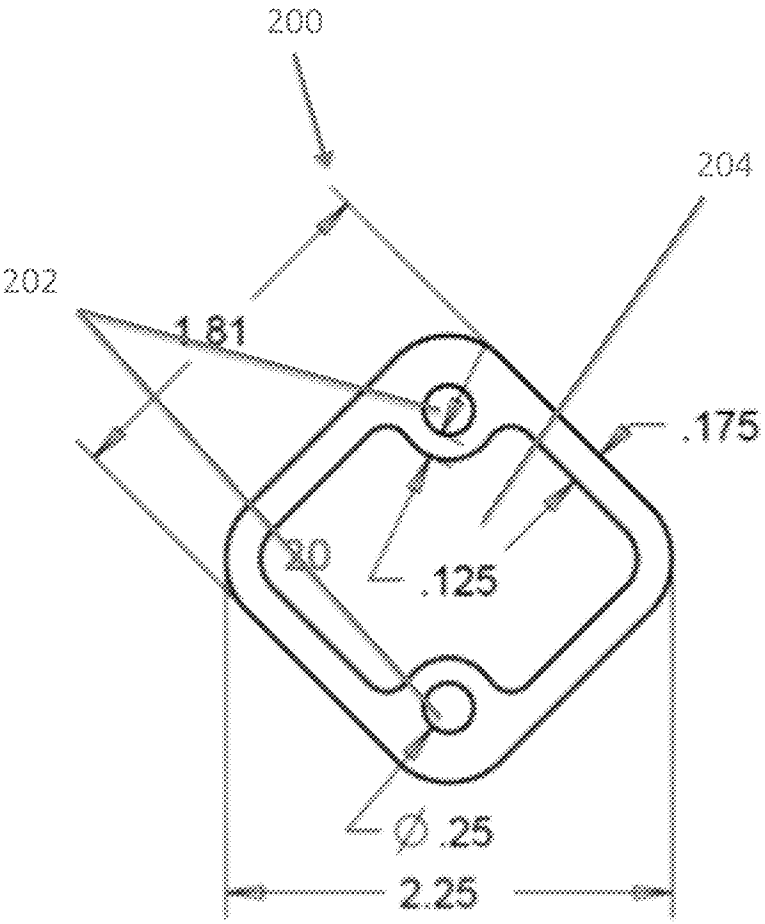
FIG. 5 is a top view of a broader diamond shaped standoff.
Figure 6:
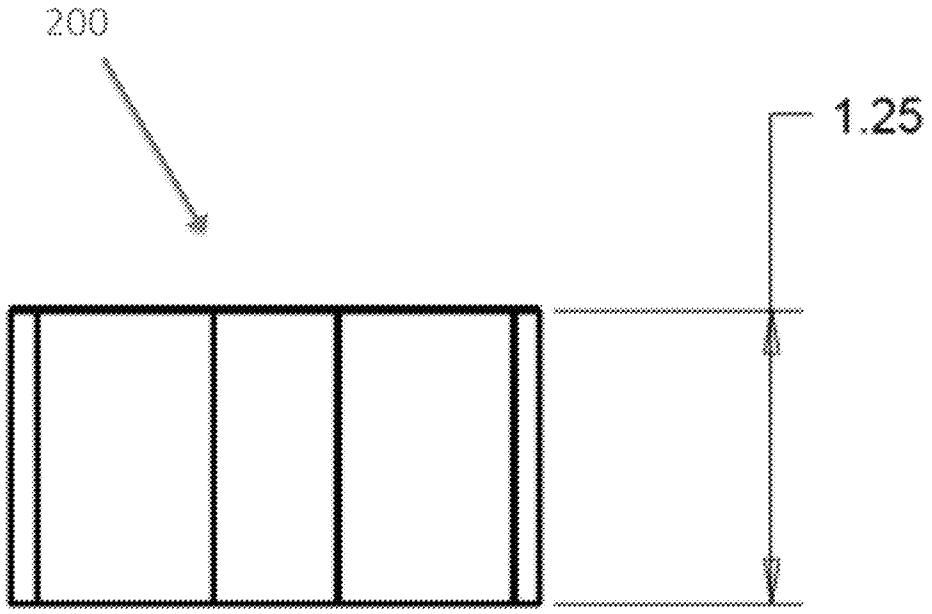
FIG. 6 is a side view of a broader diamond shaped standoff.

FIG. 4 is a perspective view of a broader diamond shaped standoff 200. It similarly comprises mounting holes 202 and a center hole hollow core 204, and supports the same construction and functionality as that of the oval/racetrack standoff. That is, it allows wiring from a cooler to pass through such that various electronic features can be constructed within the assembly. FIG. 5 is a schematic view of a broader diamond shaped standoff 200 from the top. It shows the requisite dimensions suitable for accomplishing a factory install mounting of a display assembly to a door handle, though other dimensions are possible. Here as shown, the diameter of the mounting holes is 0.25 in, the main diamond path is 0.175 in, width 1.81 in, width around mounting holes 0.125 in, and length (corner to corner) 2.25 in. Preferably, the inside corners of some areas of the standoff extrusion are not sharp, and have fillets or rounds. Though, it is possible to design the standoff either way: with round fillets on their inside corners, or just keep the hidden edges sharp. FIG. 6 is a side view of the broader diamond shaped standoff 200, illustrating its relative dimensions in one embodiment. FIG. 6 shows that the diamond standoff here is slightly more long than wide. The holes 202 on the extrusion do not necessarily have to be centered on its thickened portion, as they can be offset a bit. However, the line of holes can be centered, on its thicker portion, in variations, to get the most support. Additionally, the thicker portion of the standoff can be wider, or alternatively, the entire flat back area can be made thicker to eliminate or reduce the thickened portion.

Figure 7:
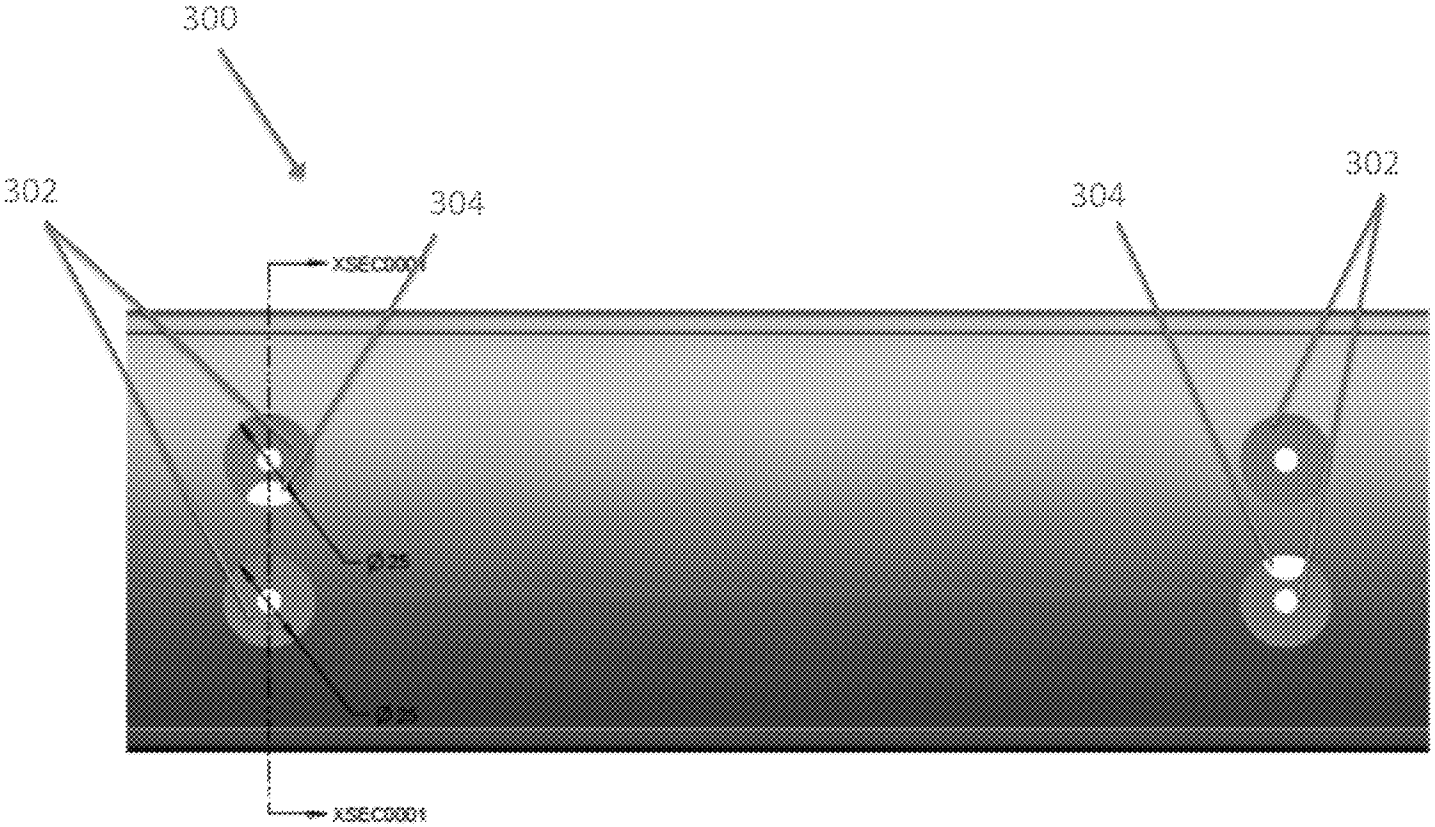
FIG. 7 is a front view of a display assembly.

FIG. 7 illustrates a front view of the display assembly 300, minus any display insert. As can be seen, the display assembly is generally rectangular, and in this embodiment has a convexly curved surface. Along each side of the curved surface is a lip flange 306 (highlighted in FIG. 9). When one of the display assembly's end caps is removed (e.g., the top), a display ad and its optional clear flexible cover (e.g., of thin transparent plexiglass) may be inserted into the display assembly. The end cap is then replaced. The display ad is thereby held in by the lip flange and the respective end caps. FIG. 7 also shows apertures 302 (diameters 25 in each) for receiving fastening screws for various kinds of attachment brackets; as well as a partially obscured view of rear insertion holes 304 through which electrical wiring is passed.

Figure 8:
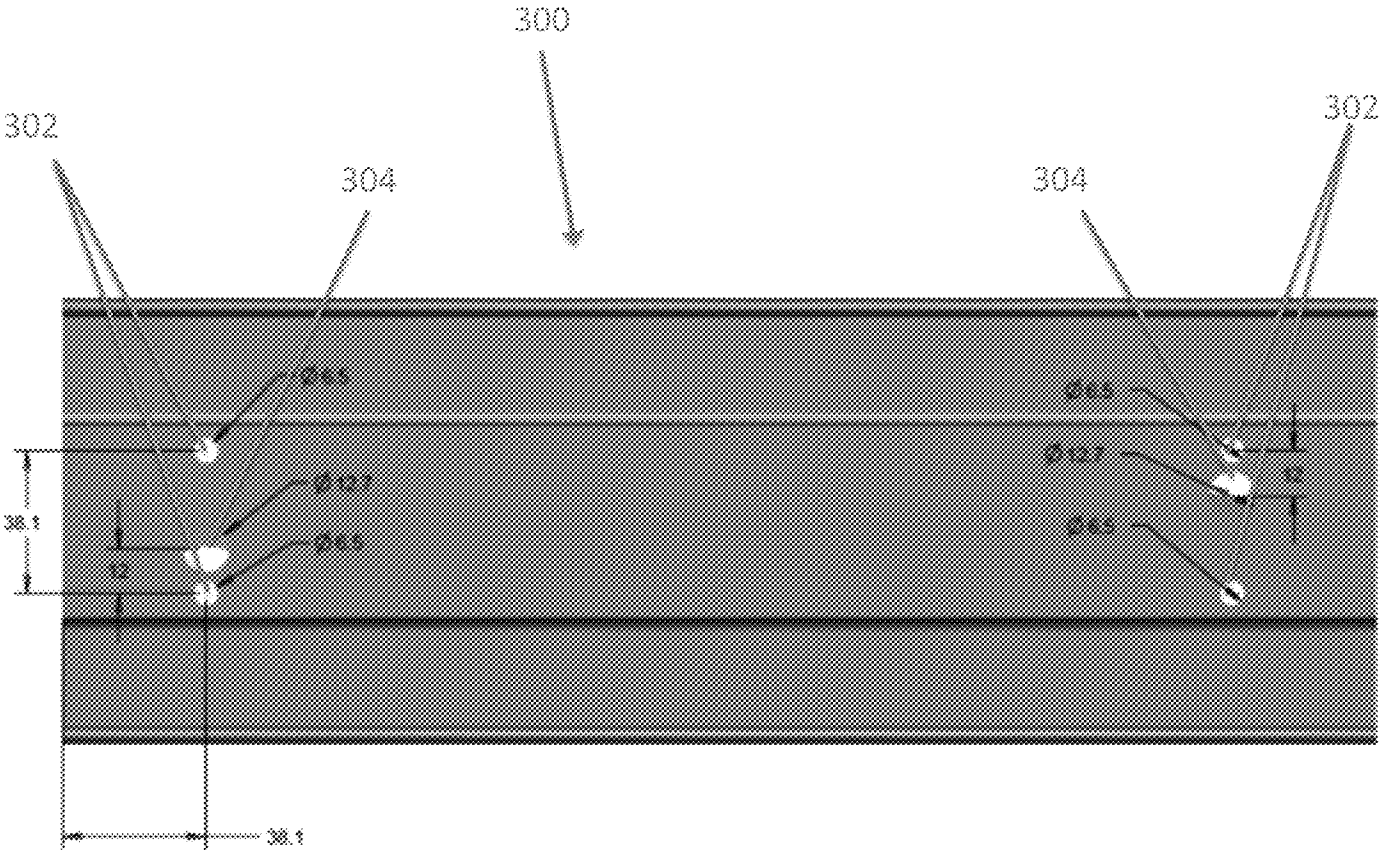
FIG. 8 is a rear view of a display assembly.

FIG. 8 is a rear view of a display assembly 300. As shown, it comprises a modified main handle cross-section and set of apertures 302 to accommodate the standoff 200, either the oval or diamond shaped standoff. Shown in full are the insertion holes 304 through which wiring passes via the standoffs from a cooler door. A base 308 is a slightly protruding segment of the main handle cross-section, protruding so as to facilitate the attachment to the handle foundation 102 via the standoffs 200.

Figure 9:
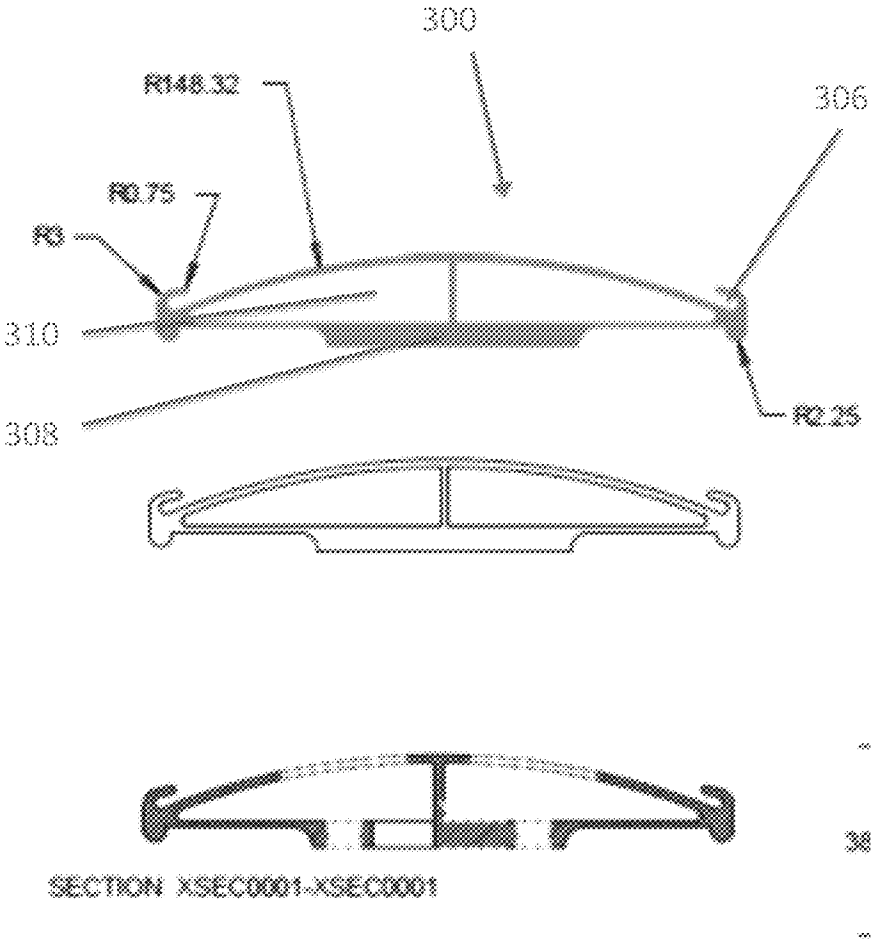
FIG. 9 is a top-side view of a display assembly.
Figure 10:
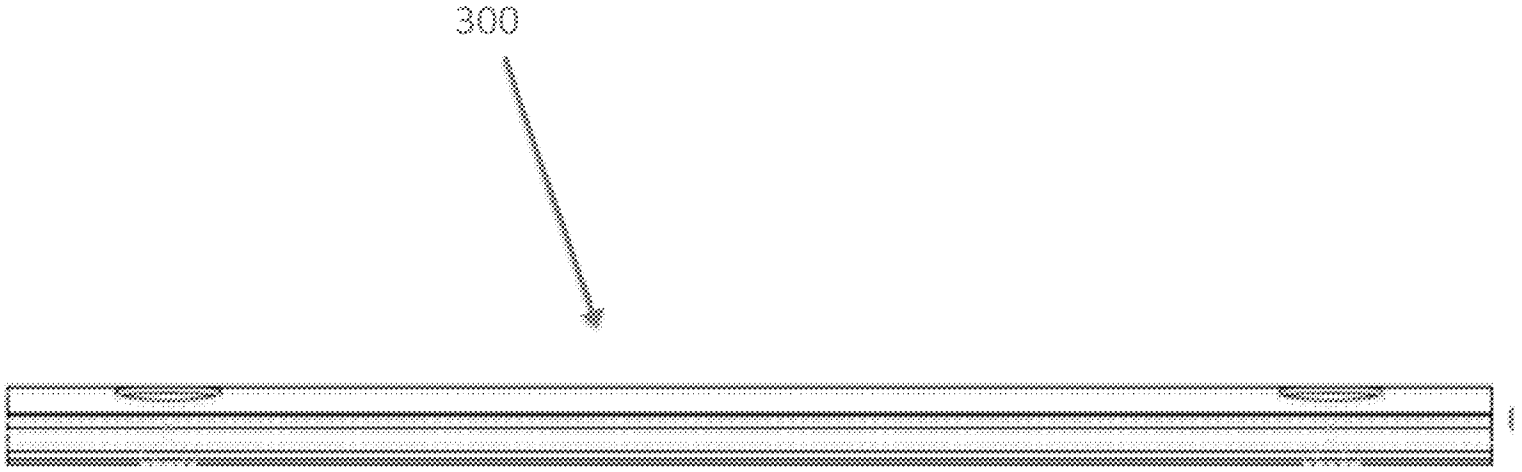
FIG. 10 is a side view of a display assembly.

FIG. 9 is a top-side view of the display assembly 300. The base 308 serves as a mount, creating sufficient separation between the door handle and the display assembly. An end cap is placed on the end opening 310, fixing an advertisement display insert within the assembly. Further, the lip flange 306, together with the end caps, hold in the display ad. FIG. 10 is a side view of the display assembly 300.

Figure 11:
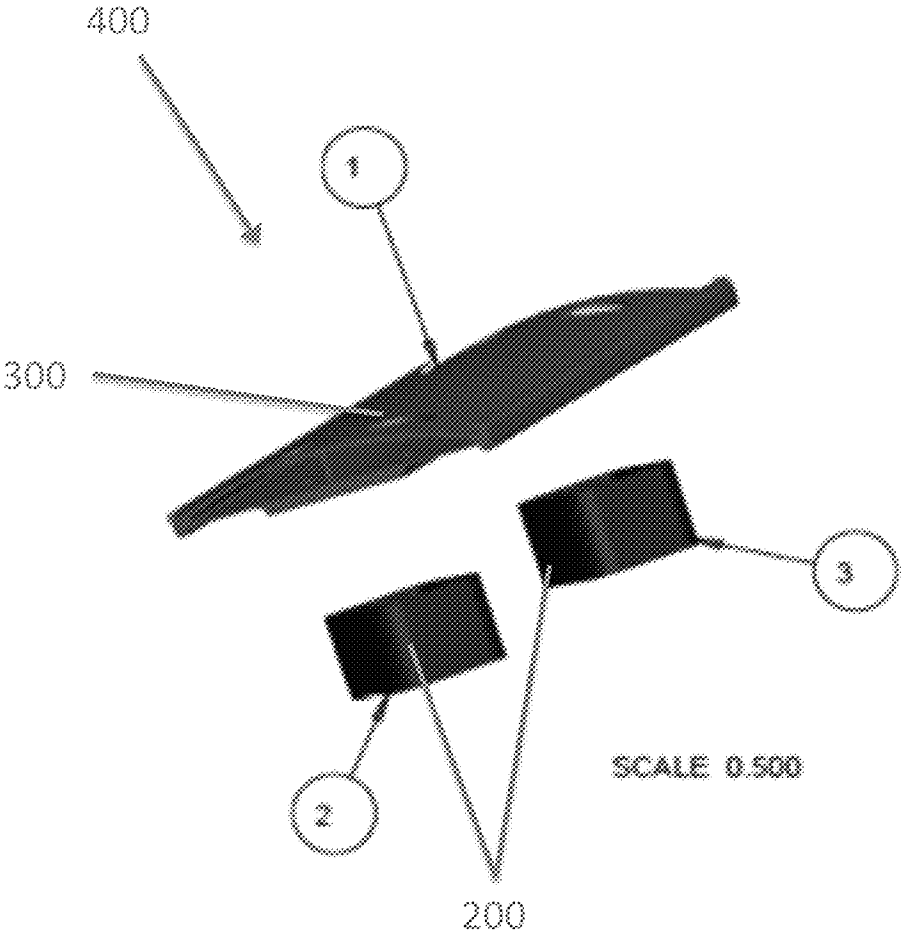
FIG. 11 is an exploded view of a standoff display assembly.
Figure 12:
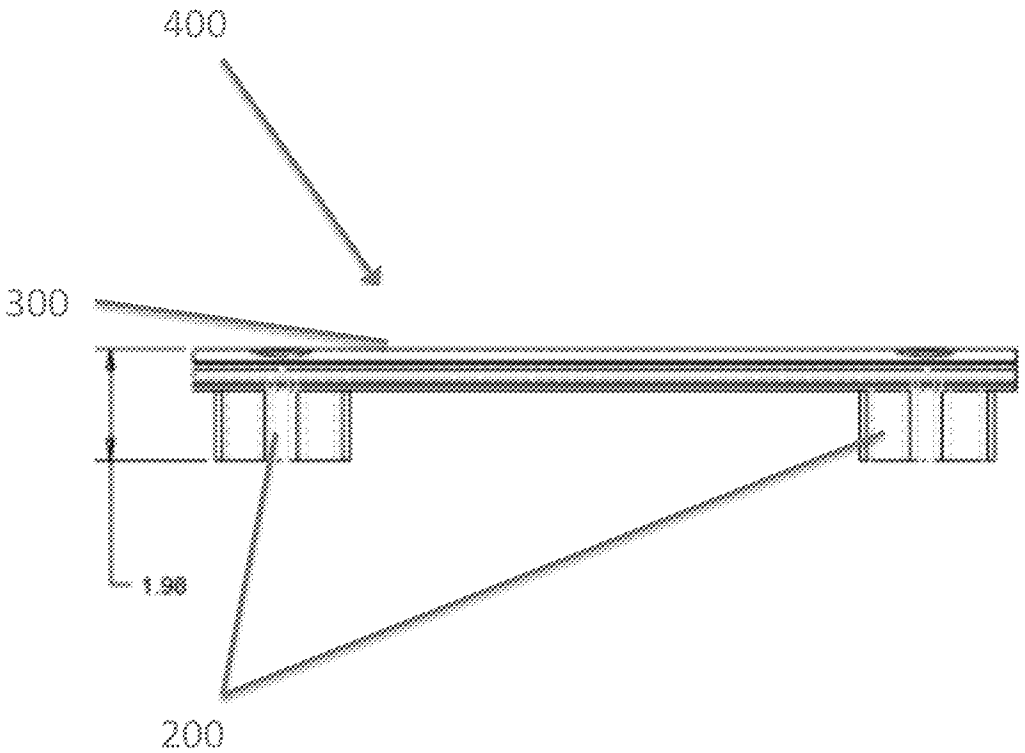
FIG. 12 is a side view of a standoff display assembly.
Figure 13:
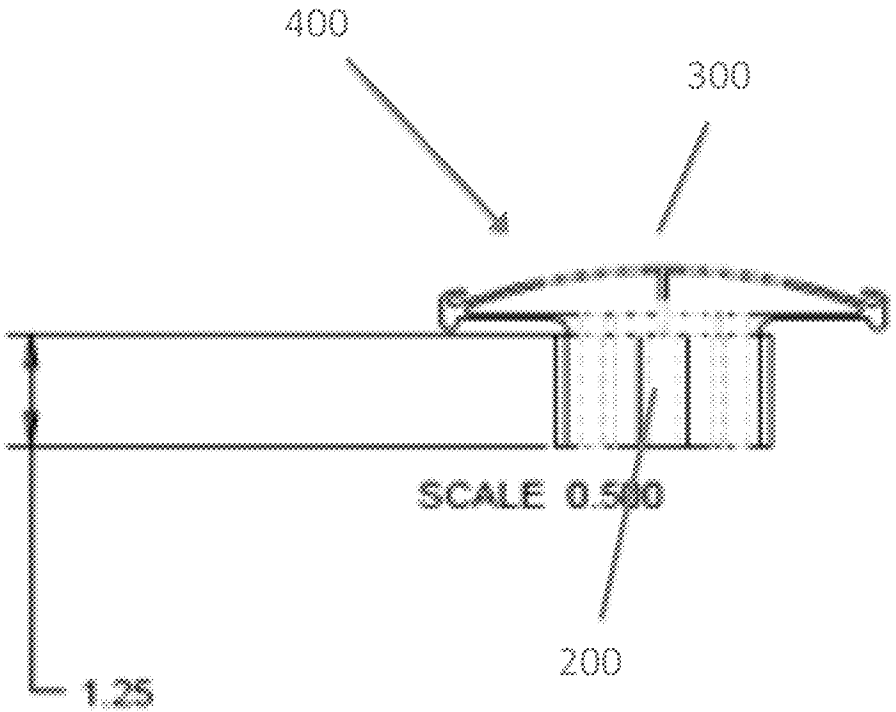
FIG. 13 is a top-side view of a standoff display assembly.

FIG. 11 is an exploded view of the display assembly 300 and its two diamond shaped standoffs 200, prior to assembly. The standoffs are attached to the rear of the display assembly through the apertures, via the mounting holes 202 of the standoffs. On the standoffs for the factory unit, there are 8 MM bolts and threaded inserts in the cooler doors to receive them. The standoffs should be mounted sideways to help prevent torque. The display assembly apertures 302 and door handle holes must be laid out similarly. A concave area of the display assembly can be flattened (referring to base 308) to provide sufficient room for mounting the standoffs. FIG. 12 shows the standoffs 200 connected to the display assembly 300. The height from the bottom of the standoffs to the outer surface of the display assembly is 1.96 in. FIG. 13 is top-side view of a standoff display assembly. The height of the standoff is 1.25 in.

The OEM door handle assembly 100 is specifically designed to interoperate with a cooler's electrical system. There is commonly a DC transformer inside the cooler to convert AC to DC voltage. The transformer could be 12V inside the cooler's electrical system, compatible with LEDs and customized modules. Many coolers use LED lighting strips to illuminate the edge of cooler glass.

It has been discovered that it would be advantageous to develop an attachment to a storage unit that operates as a display assembly as a door handle. A cooler is a type of storage unit that the attachment is intended to be used for. Four embodiments of the attachment are described below. Also described is a method for performing a retrofit install of the assembly for the first two embodiments. The first embodiment is a display assembly as a door handle used with a cable conduit and associated wire. The second embodiment is a display assembly as a door handle with no electrical wire. The third embodiment is a display assembly as a door handle which uses an inset handle for opening and a flat surface for a sticker ad with no cover. The fourth embodiment is a different structural version of a display case door handle accessory with a recessed panel for holding advertising material, which also uses an inset handle for opening and a flat surface for a sticker ad with no cover. Each embodiment is discussed in turn.

Figure 14:
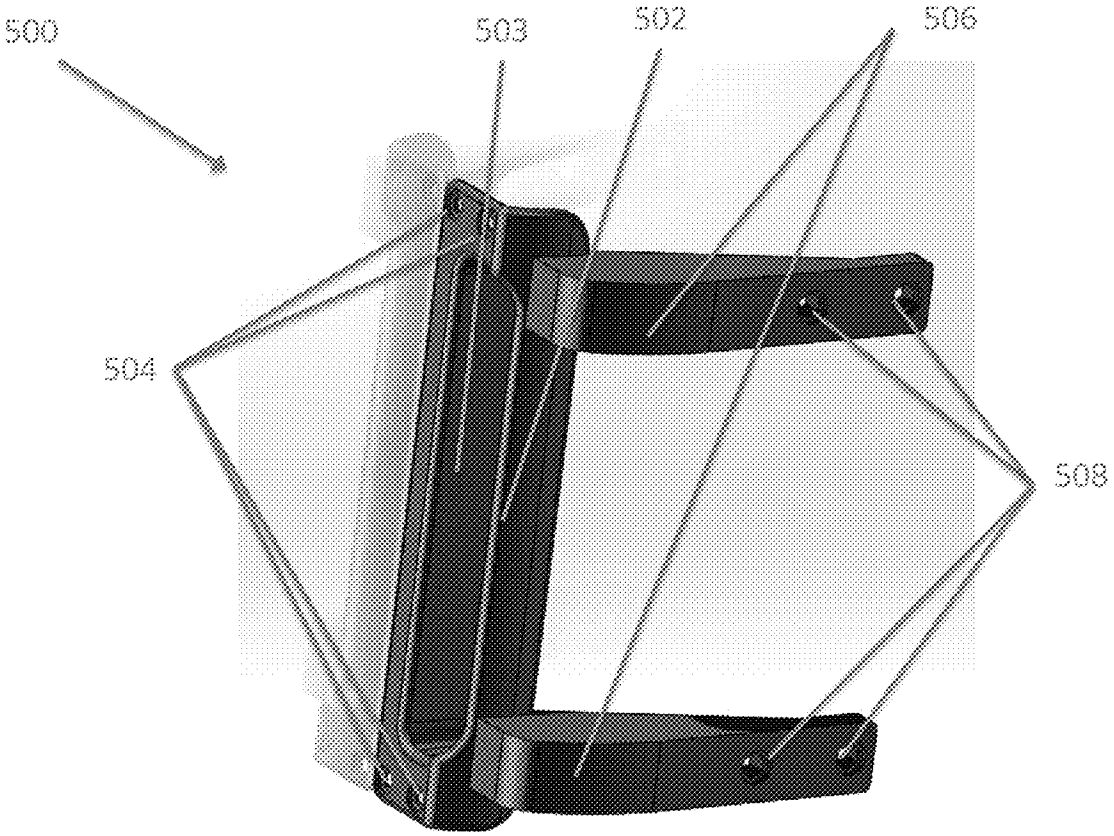
FIG. 14 is a view of an outrigger used to mount a display assembly as a door handle used with a cable conduit and associated electronic wire.

Embodiment 1: display assembly as a door handle used with a cable conduit and asssociated electronic wire FIG. 14 depicts an outrigger 500 that is used to mount a display assembly as a door handle used with a cable conduit and associated electronic wire. It has a door abutment 502 that couples to the door. The door abutment 502 has 4 door abutment apertures 504, two on each side, through which screws are positioned to couple the door abutment 502 to the door on a storage unit. The door abutment 502 also has a depression protrusion inset 503. To grip the handle and open the door of the storage unit on which the display assembly 500 is attached, the user places his or her hand in the canal 503. The canal 503 is of sufficient size and depth to allow a hand to fit. The outrigger 500 also has two display abutments 506. On each display abutment 506 there are two display abutment apertures 508, through which screws are positioned to couple the outrigger 506 to a display containing an advertisement.

Figure 15:
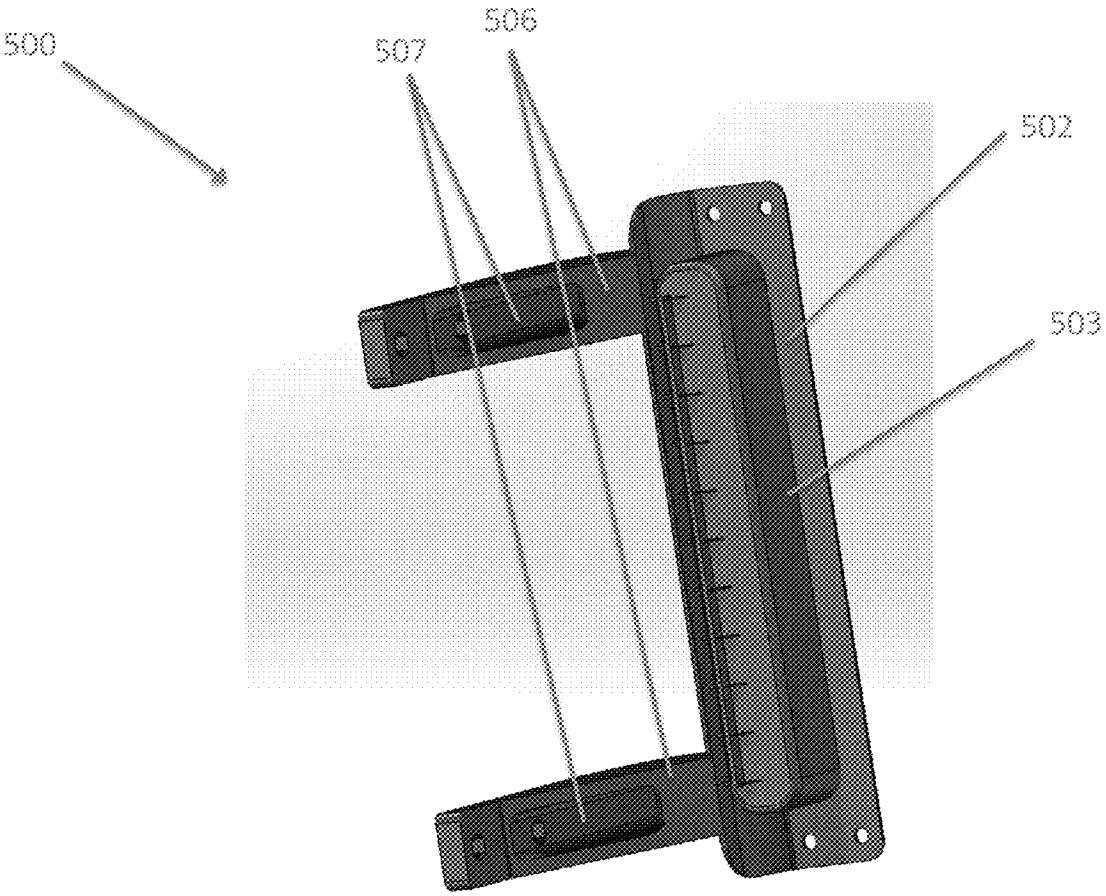
FIG. 15 is a front view of the outrigger of FIG. 14.
Figure 16:
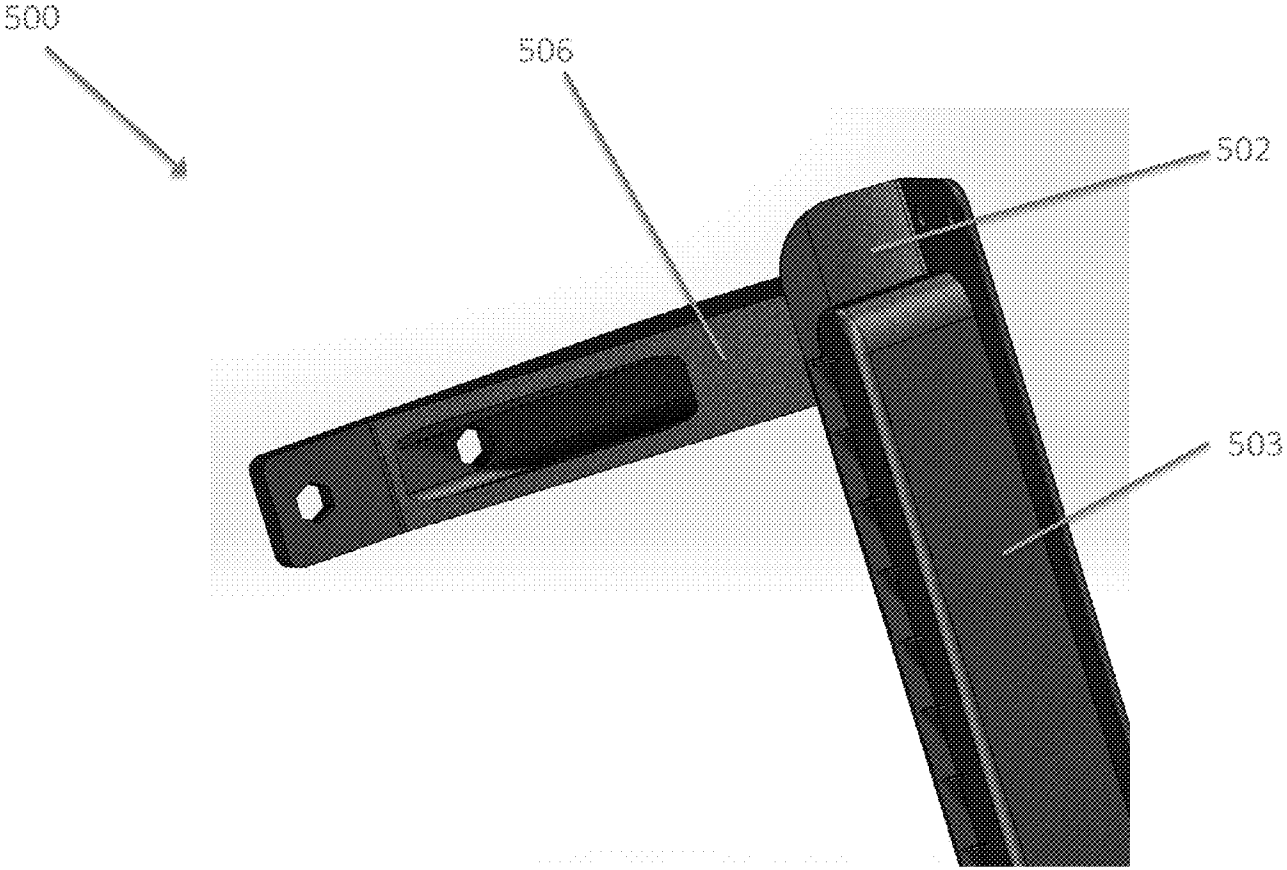
FIG. 16 is a rear view of the outrigger of FIG. 14.
Figure 17:
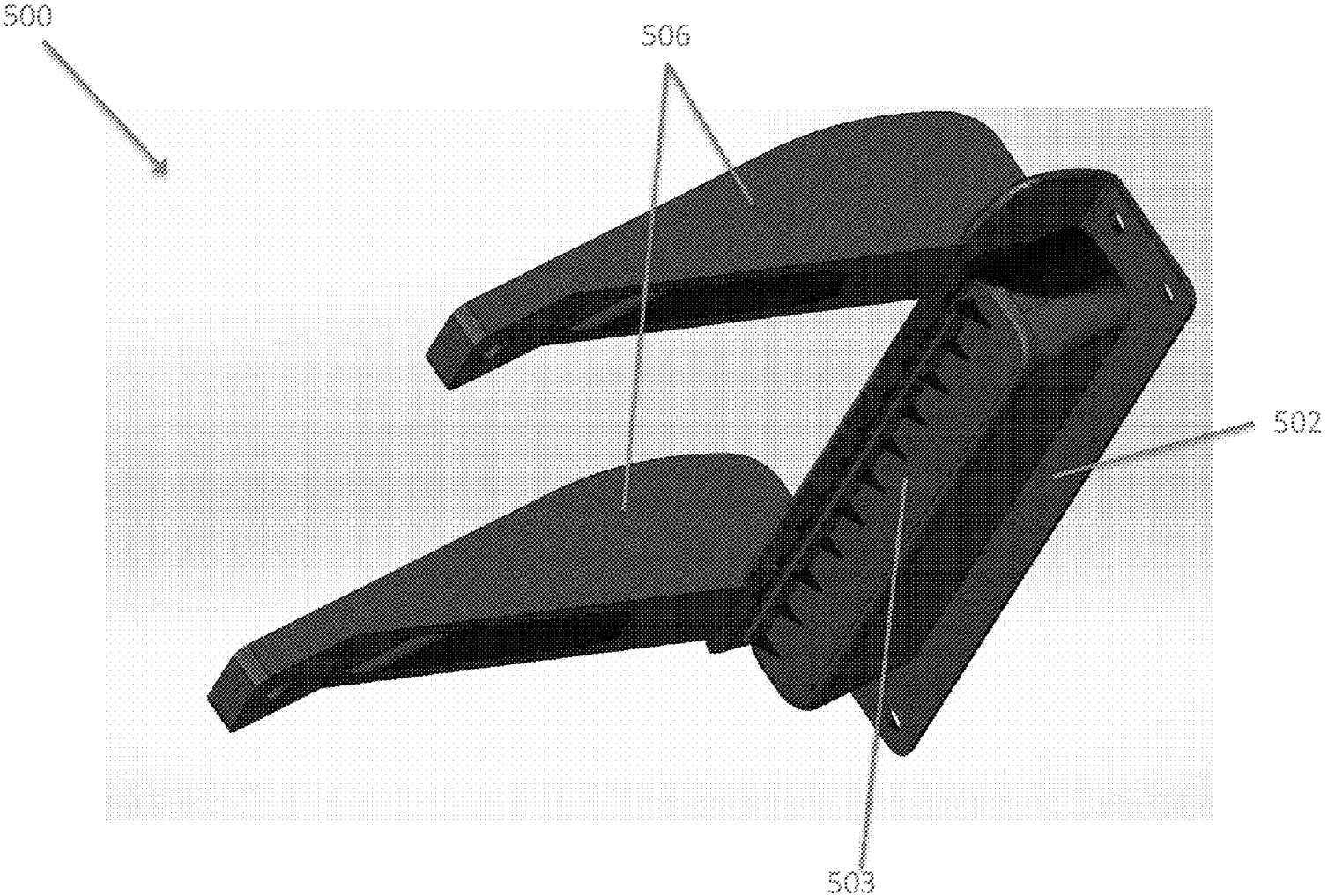
FIG. 17 is a rear view of the outrigger of FIG. 14.

FIGS. 15-17 are different views of the outrigger 500. FIG. 15 is a rear view. In FIG. 15, the recesses 507 on the display abutments 506 can be seen. These recesses 507 provide room to abut the display accessory 520. FIG. 16 is a rear view in which the canal part of the handle protrudes. FIG. 17 is also a rear view. In FIG. 17, the display abutments 506 are depicted more clearly. In FIG. 17, the display abutments 506 fan out, increasing in width along the direction moving towards the door abutment 502. Shown also are demarcations 505, each located a fixed distance from one another, and which provide support on the canal 503 part of the handle.

Figure 18:
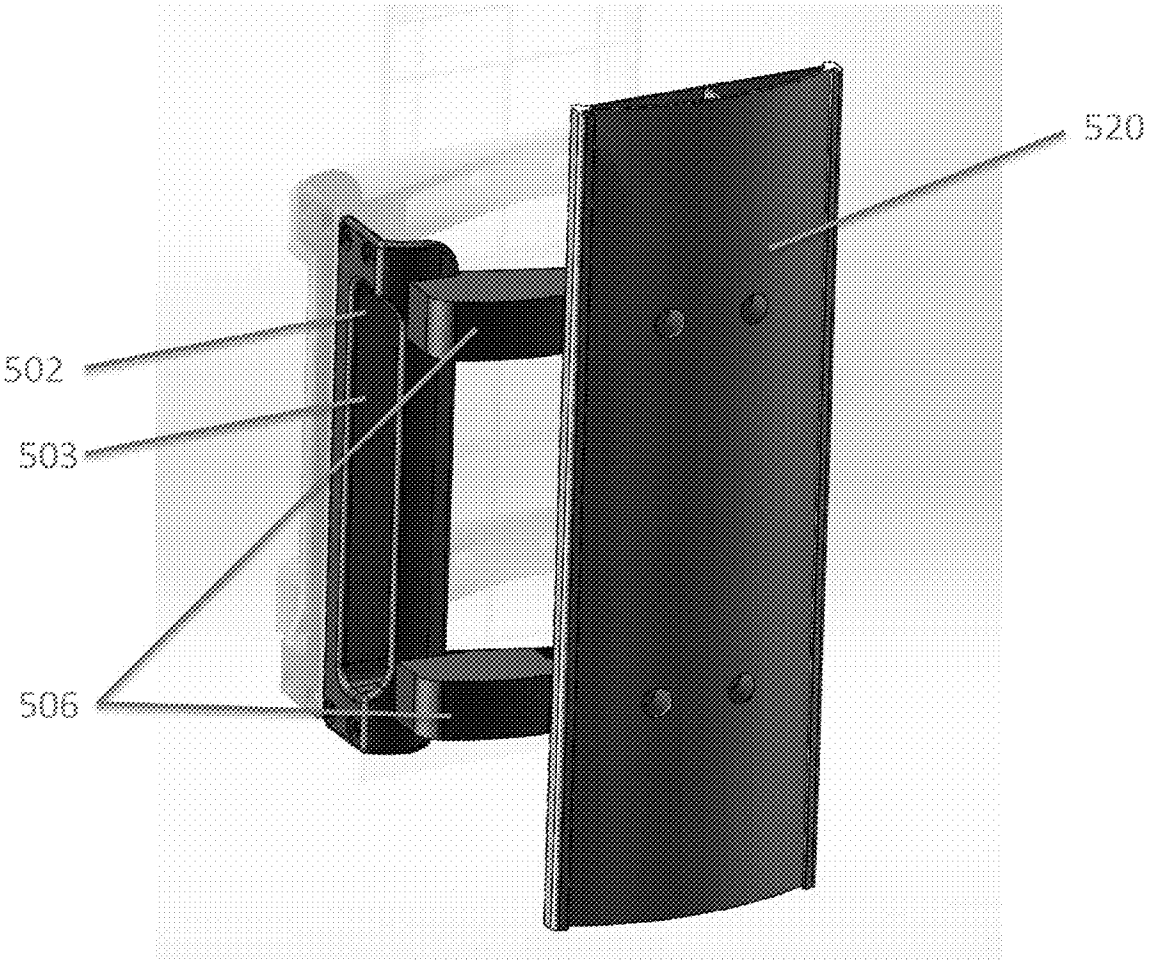
FIG. 18 is a view of a display assembly as a door handle used with a cable conduit and associated electronic wire.
Figure 19:
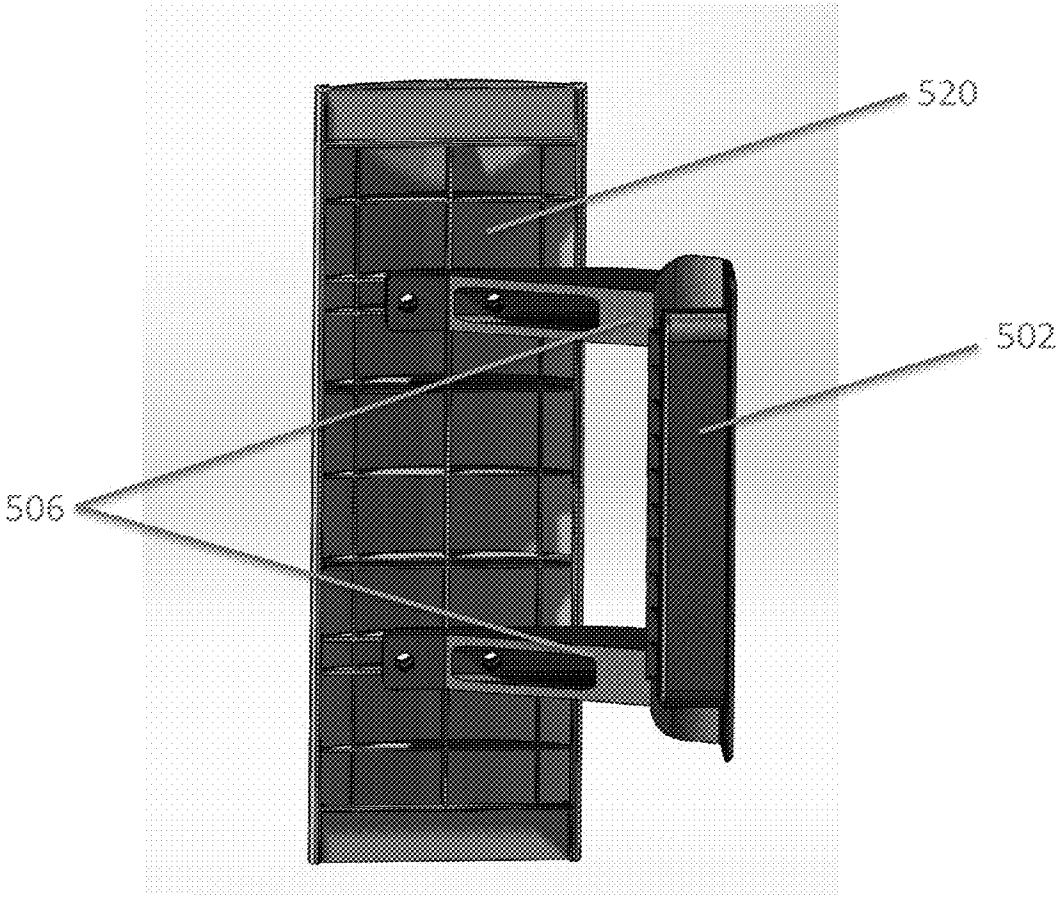
FIG. 19 is a rear view of the display assembly of FIG. 18.
Figure 20:
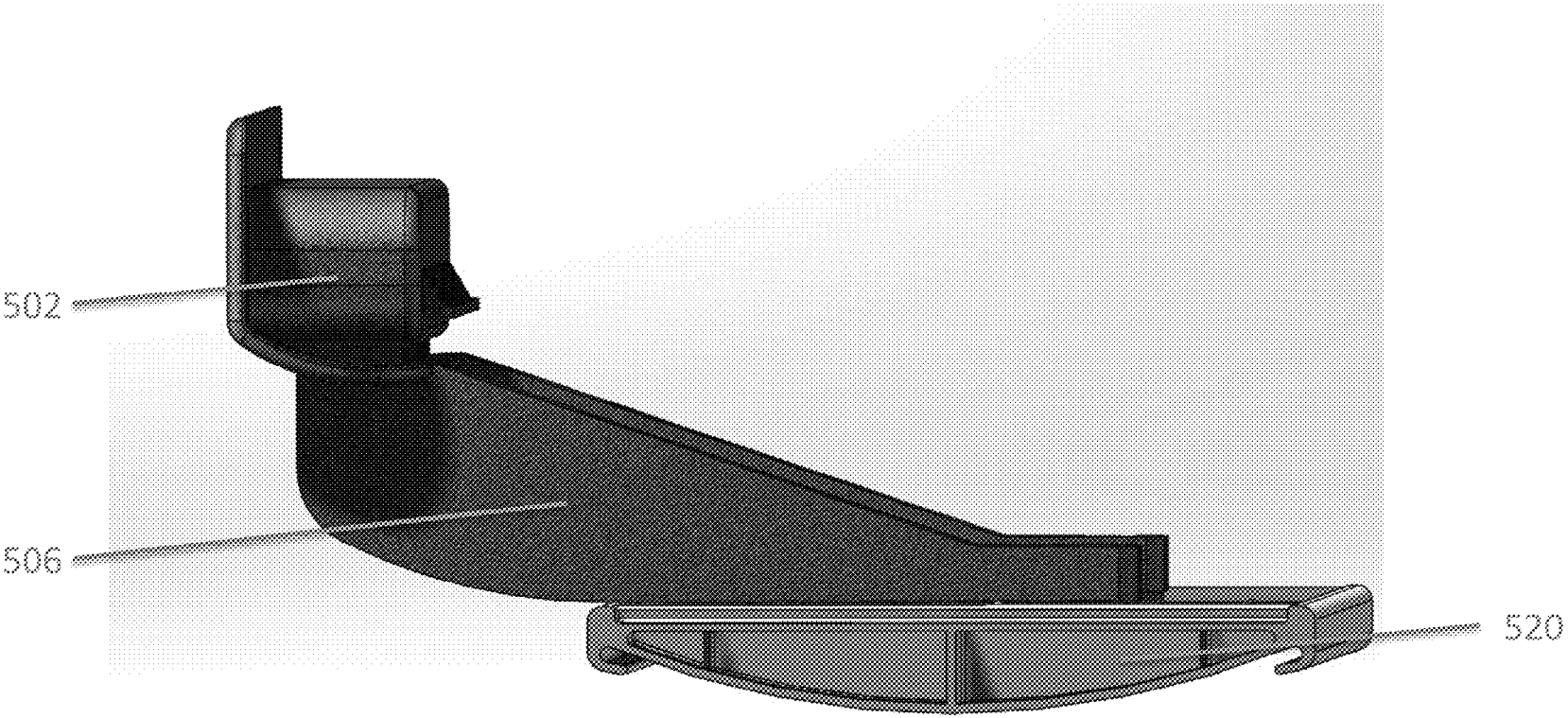
FIG. 20 is a top view of the display assembly of FIG. 18.

FIGS. 18-20 show the display assembly as a door handle used with a cable conduit and associated electronic wire, with both the outrigger 500, as well as the display accessory 520 coupled to the outrigger 500. FIG. 18 is a view from the front. As can be seen, the display accessory 520 is coupled to the display abutments 506. Successful coupling is achieved in part via the display abutment apertures 508. FIGS. 19 and 20 are rear and top views, respectively. The display accessory 520 comprises opposing lip flanges and a surface for displaying an advertisement.

This first embodiment is installed on a storage unit, and is in communication with the storage unit's electrical system. To accomplish this, there is at least one wire in electrical communication with the storage unit's electrical system that passes through the display assembly to provide power to the display assembly. The wire (not shown) passes from the cooler door frame through the standoff 200, then through the rear of the outrigger 500 and into the display accessory 520.

Embodiment 2: display assembly as a door handle with no electrical wire

Figure 21:
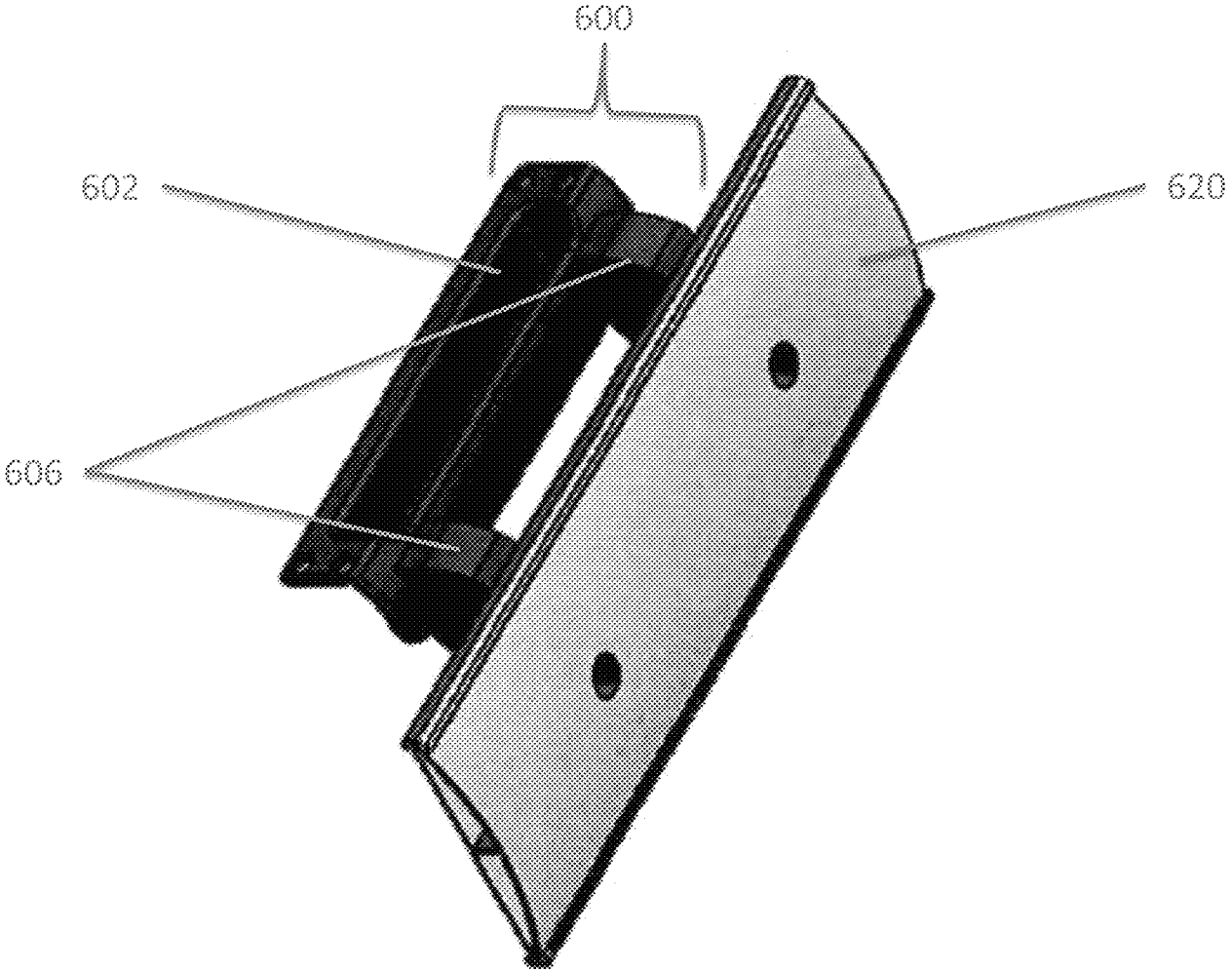
FIG. 21 is a view of a display assembly as a door handle with no electrical wire.

FIG. 21 is a view of an embodiment of a display assembly as a door handle with no electrical wire. It has an outrigger 600 having a door abutment 602 and two display abutments 606, and a display accessory 620. The display accessory 620 is coupled to the outrigger 600 via the display abutments 606. Like embodiment 1, the display accessory 520 comprises opposing lip flanges and a surface for displaying an advertisement.

Figure 22:
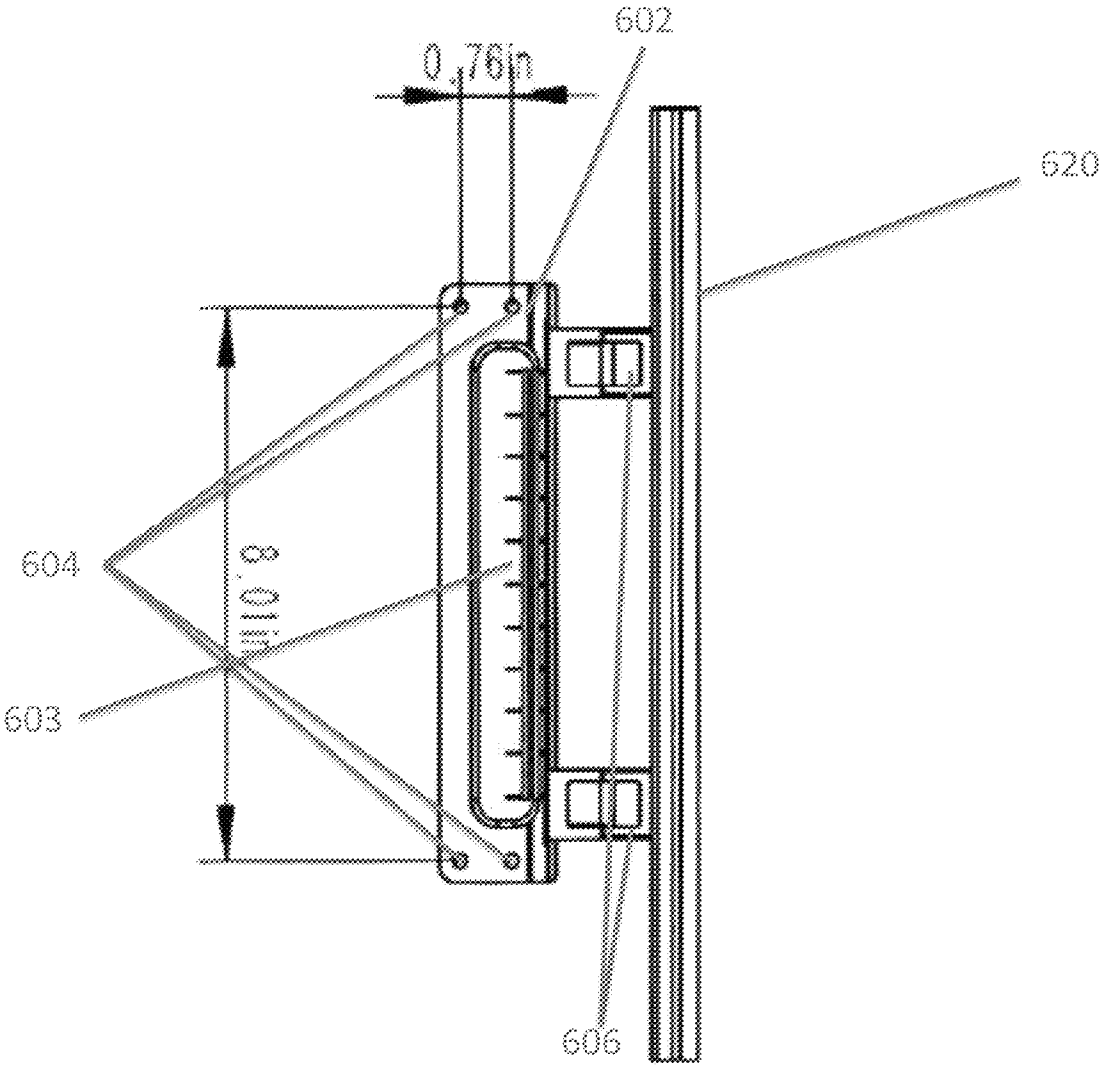
FIG. 22 is a drawn-to-scale side view of the display assembly of FIG. 21.

FIG. 22 is a drawn-to-scale side view of the display assembly, with the outrigger 600 coupled to the display accessory 620 via the display abutments 606. In FIG. 22, the door abutment apertures 604 can be seen as well, as can demarcations 605. The distance between the proximal apertures and distal apertures is 0.76 in. on both sides of the door abutment; and, the distance between the two sets of door abutment apertures is approximately 8.01 in. FIG. 22 shows the outrigger 600 from the rear, so the canal handle 603 is protruding. The canal handle 603 has fixed-length demarcations 605 across its length.

Figure 23:
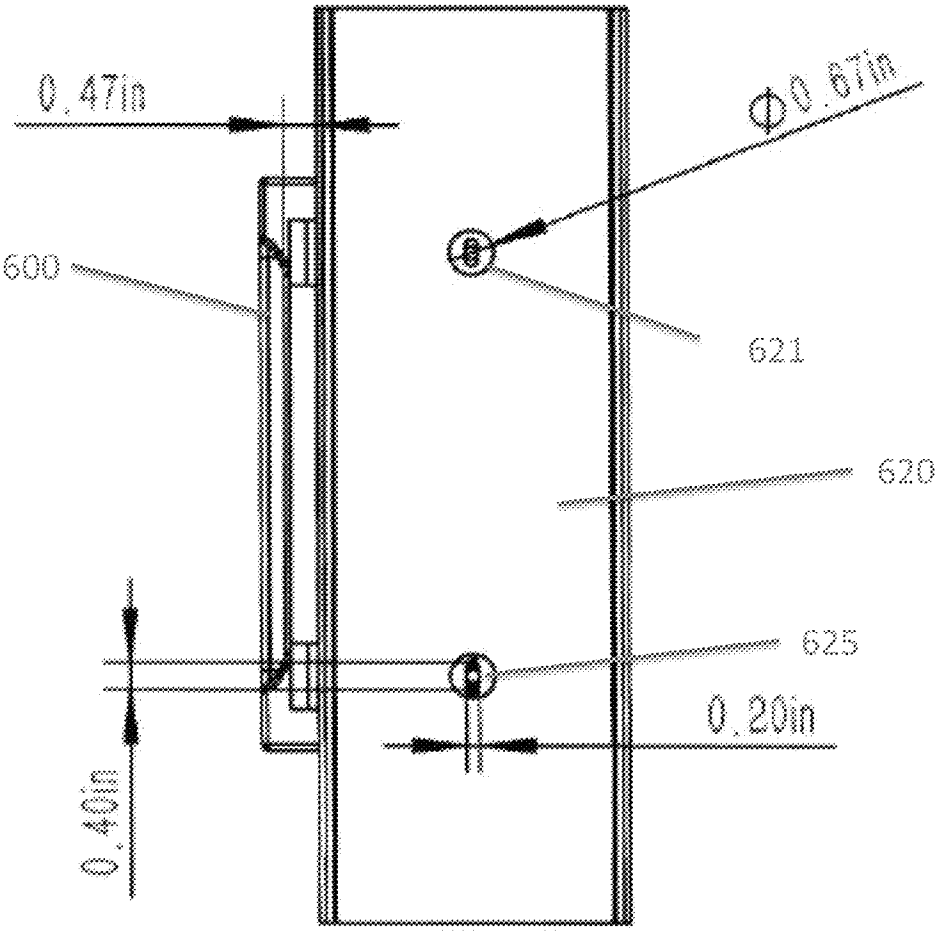
FIG. 23 is a drawn-to-scale front view of the display assembly of FIG. 21.

FIG. 23 is a drawn-to-scale front view of the display assembly. It shows that the distance between the portion of the door abutment 602 closest to the display accessory 620 is 0.47 in.; the diameter of a display accessory aperture 621 is 0.67 in.; the height and width of a ridge 625 within the display accessory aperture is 0.40 in. and 0.20 in., respectively.

Figure 24:
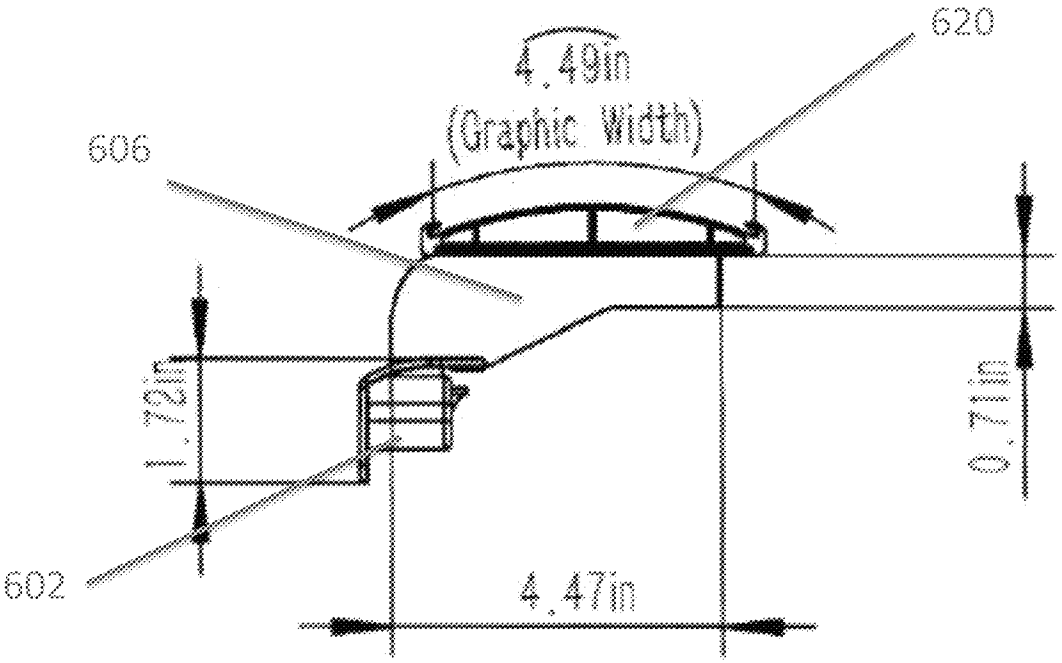
FIG. 24 is a drawn-to-scale top view of the display assembly of FIG. 21

FIG. 24 is a drawn-to-scale top view of the display assembly. The door abutment has a height of 1.72 in. The width of the narrowest section of the display abutment 606 is 0.71 in. The graphic width of the display accessory is 4.49 in., and the length of the display abutment is 4.47 in.

Figure 25:
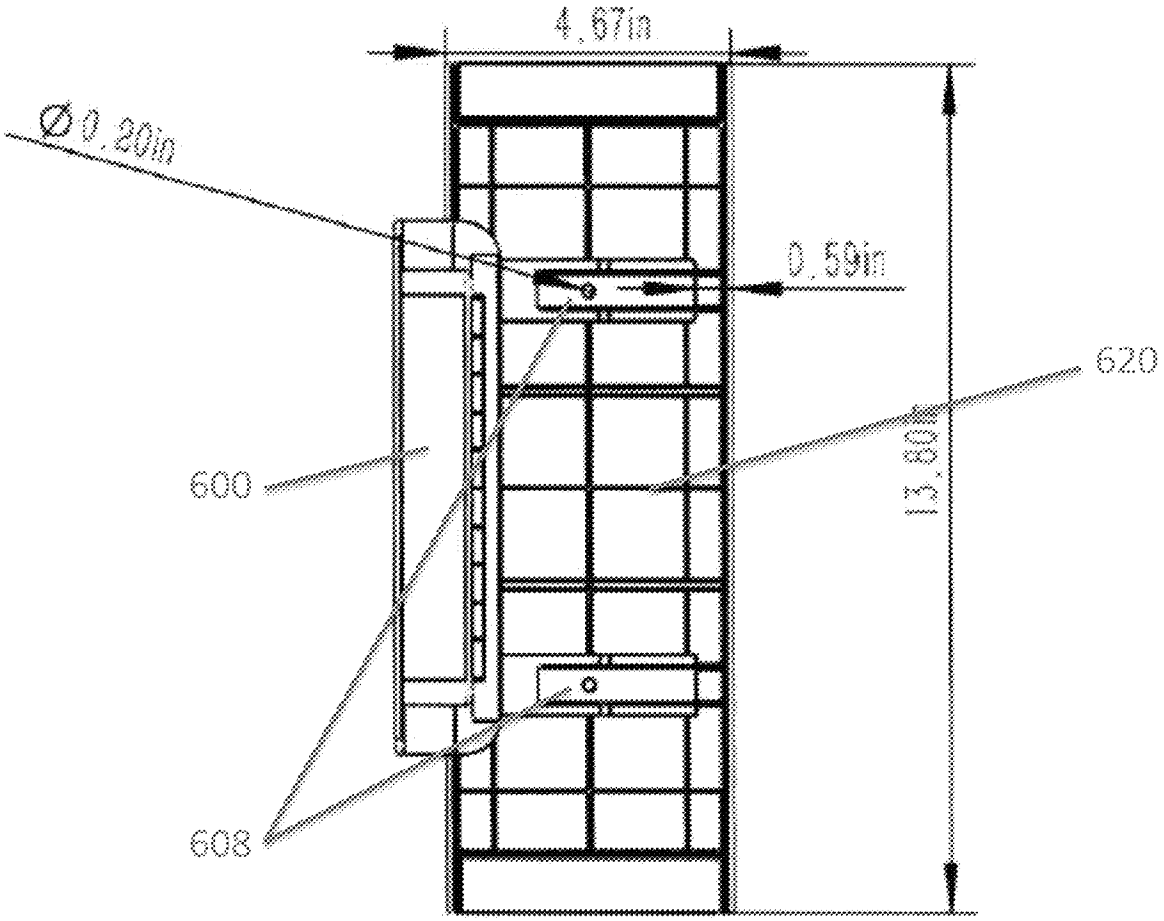
FIG. 25 is a drawn-to-scale rear view of the display assembly of FIG. 21.

FIG. 25 is a drawn-to-scale rear view of the display assembly. The display accessory 620 has a height and width of 13.80 in. and 4.67 in., respectively. The display abutment apertures have a diameter of 0.20 in. each. The distance between the distal end of the display abutments and an end of the handle is 0.59 in.

Figure 26:
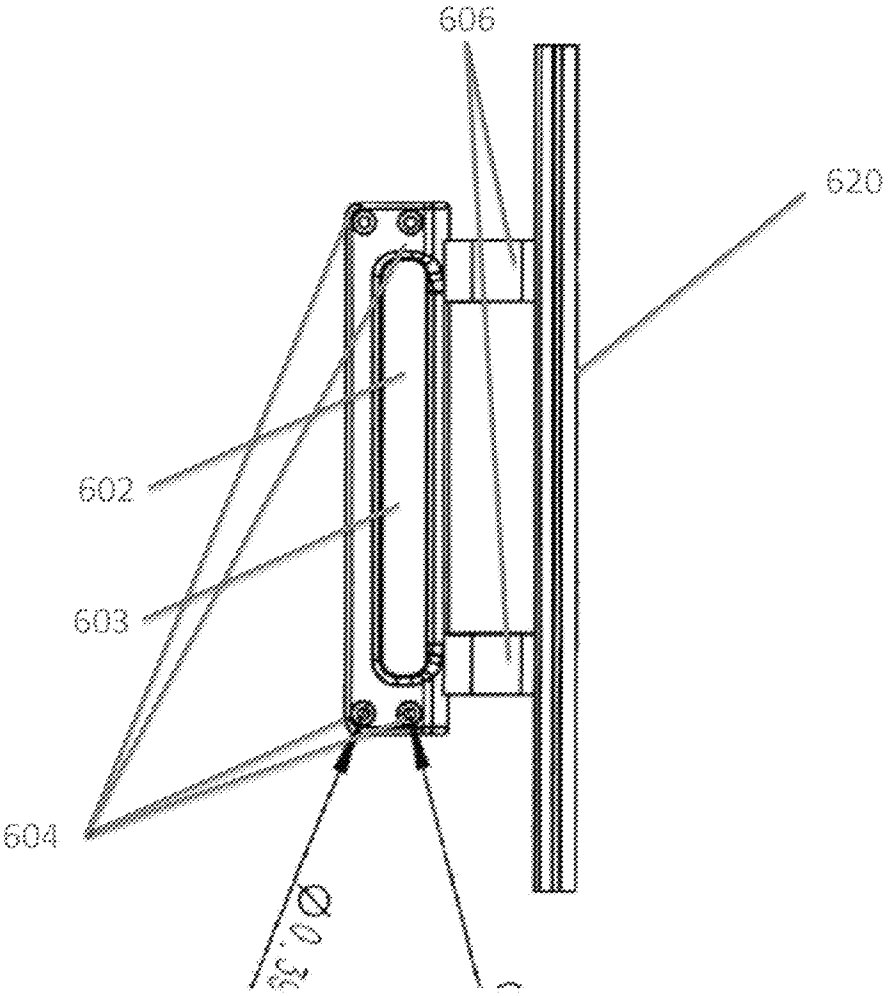
FIG. 26 is a drawn-to-scale side view of the display assembly, depicting an opposite view of FIG. 22, viewing the outrigger from the front.

FIG. 26 is a drawn-to-scale side view of the display assembly, depicting an opposite view of FIG. 22, viewing the outrigger 600 from the front. As the outrigger 600 is being viewed from the front, the handle canal 603 is depressed to allow room for a person's hand. When viewed from the front, the door abutment apertures have a diameter of 0.36.

Method to Retrofit Install Embodiments 1 and 2

Described next is how a person is to perform a retrofit install the display assembly as a door handle of embodiments 1 and 2.

The required tools include a stiff window scraper, needle nose pliers, Phillips head screwdriver both plain and powered (for fastest install), small hammer, masking tape or other, and a pencil. Assembly of the display assembly as a door handle with electrical wire and with no electrical wire (embodiments 1 and 2) requires a kit. The contents of the kit include an outrigger, display accessory, bottom end cap with plastic screen, top end cap, glue tube, bolts and custom screws.

Step 1. Using the stiff window scraper blade, the person should slightly lift the 4 plastic rivets 650 holding the standard handle in place.

Figure 27:
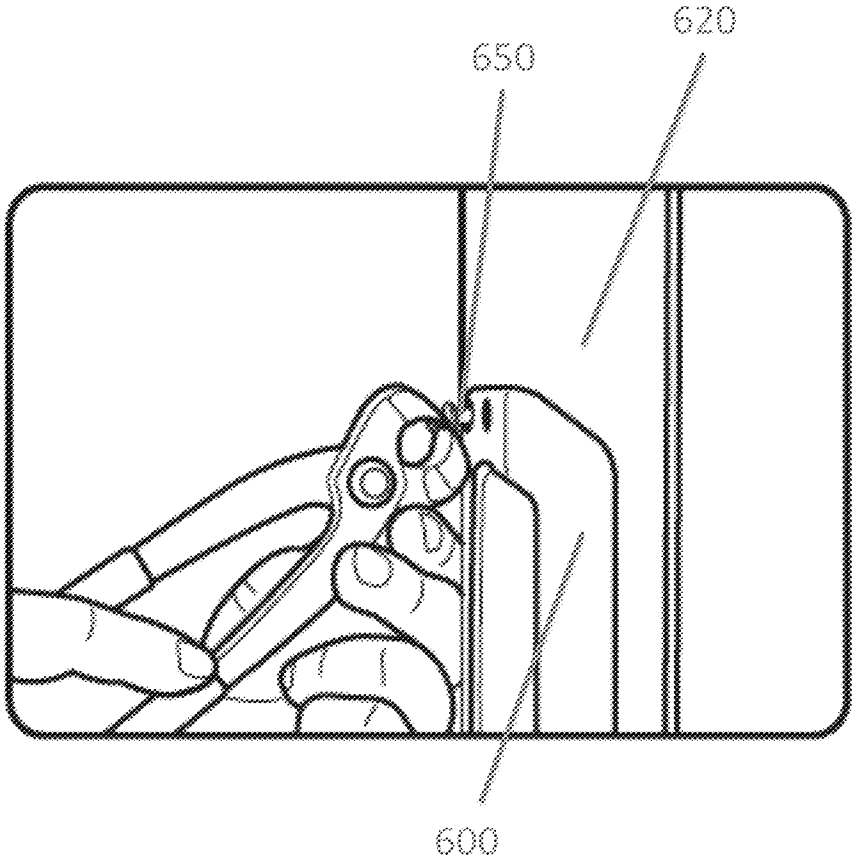
FIG. 27 is a depiction of plastic rivets being removed from an existing handle.
Figure 28:
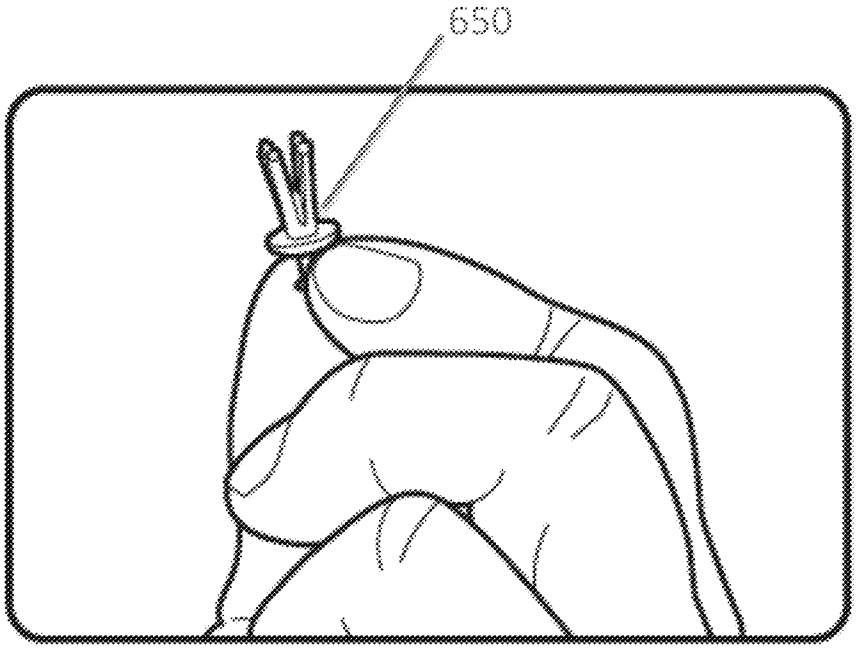
FIG. 28 is a depiction of a removed plastic rivet.

Step 2. Using the needle nose pliers, the person should pull out the plastic rivets 650. See FIGS. 27 and 28.

Step 3. After the rivets are removed, the person should pull out the existing handle.

Figure 29:
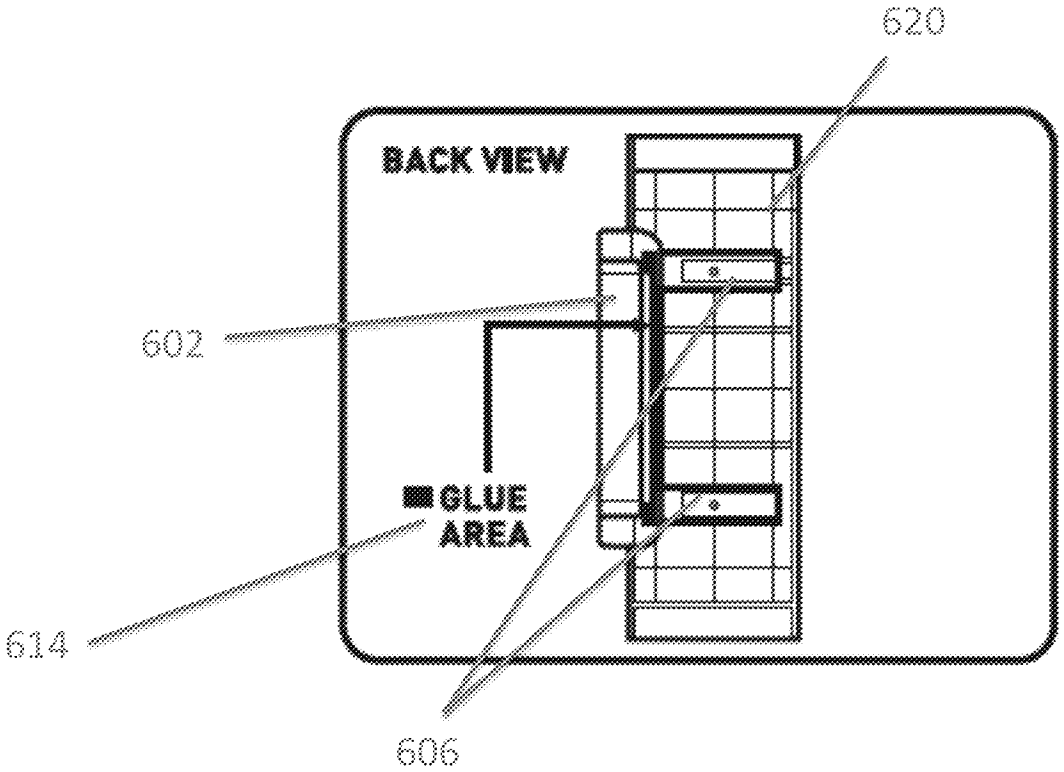
FIG. 29 is a rear view of the display assembly of FIG. 21, shown with a glue area.

Step 4. The person should place the outrigger 600 in position and mark an outline of an outrigger glue area 614 with a pencil, as shown in FIG. 29. This will guide the placing of the masking tape around the glue area, to prevent any glue that may squeeze out to mar the door frame. The person should remove the outrigger 600. The person should apply the 2 part epoxy glue supplied in the tube to the portion of the outrigger 600 where the 2 custom screws will hold it in place. The person should be careful not to overuse so that it squeezes out beyond the area which receives the glue. The 2 parts are applied evenly but do not require mixing, as they must only touch each other.

Step 5. The person should place the outrigger 600 with glue in position, and using the power screwdriver, drive 2 of the custom screws through the 2 holes in the glue area of the outrigger 600. The screws will hold it in place so glue can set and it will add additional strength. After a couple of minutes the person should remove the masking tape. See FIG. 29.

Figure 30:
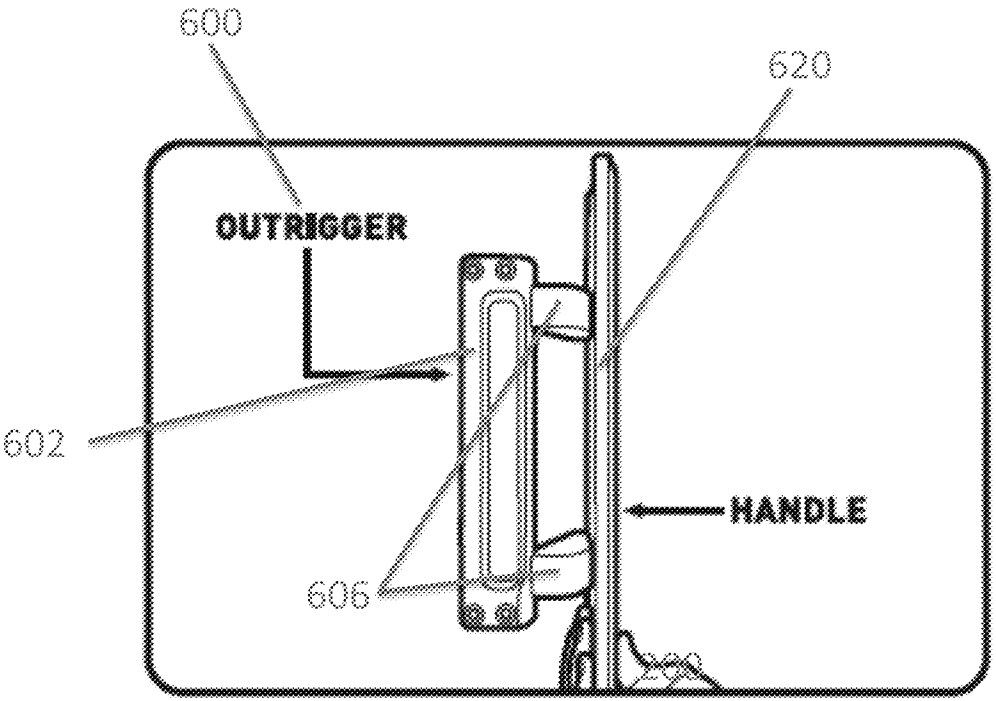
FIG. 30 is a depiction of the display assembly of FIG. 21, shown with 4 screws provided into the holes through the handle and into the holes where the rivets were prior to removal.
Figure 31:
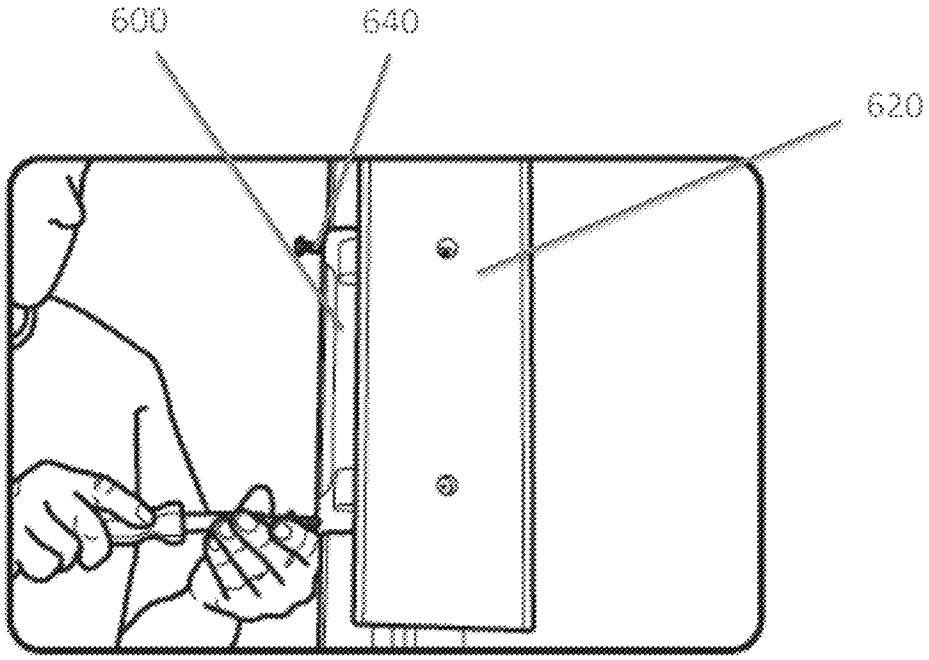
FIG. 31 is another depiction of the display assembly of FIG. 21, shown with 4 screws provided into the holes through the handle and into the holes where the rivets were prior to removal.

Step 6. The person should screw in the 4 screws provided into the holes through the new handle and into the holes where the rivets were prior to removing. The person should tighten in rotation. See FIGS. 30 and 31.

Figure 32:
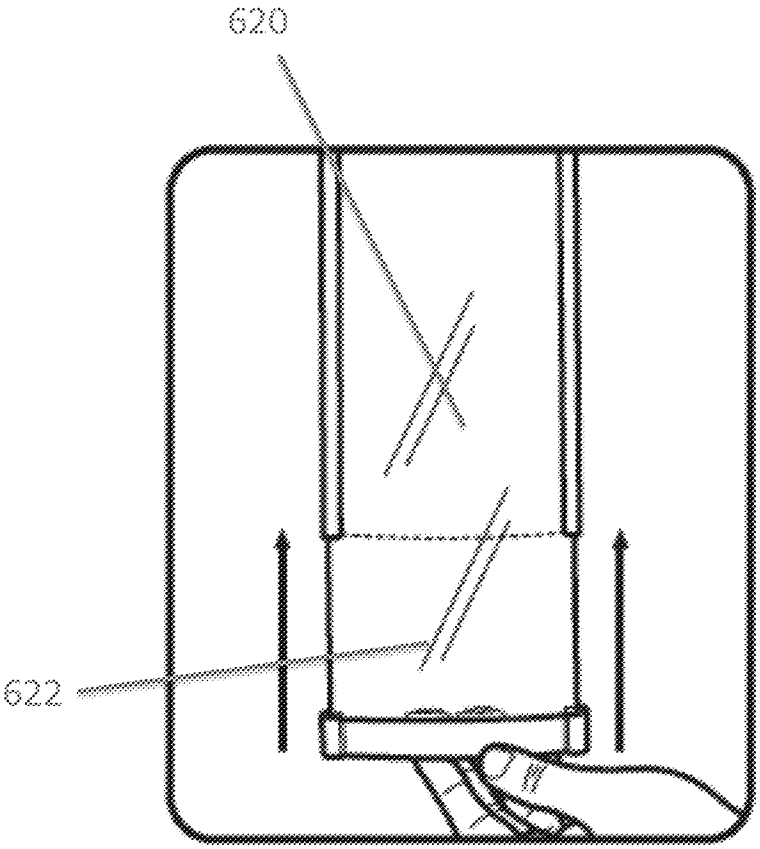
FIG. 32 is a depiction of installation of a bottom end cap with plastic cover.

Step 7. The person should install the bottom end cap with plastic cover 622 into place. It will lock into the display accessory 620, and is then not removable. It is supposed to be a tight fit and not removeable after installed. A small hammer can be used to tap into place. See FIG. 32.

Figure 33:
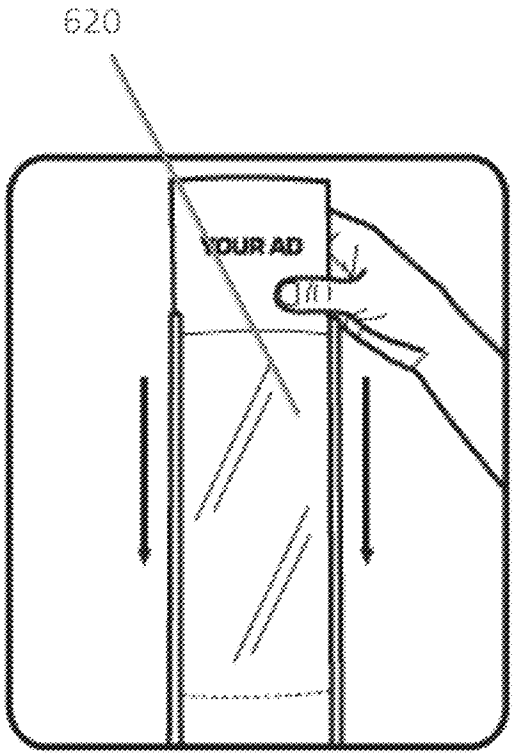
FIG. 33 is a depiction of an advertisement display being slid into place behind a plastic cover from a top end.

Step 8. The person should slide a display (e.g., advertisement) into place behind the plastic cover, from the top end. See FIG. 33.

Figure 34:
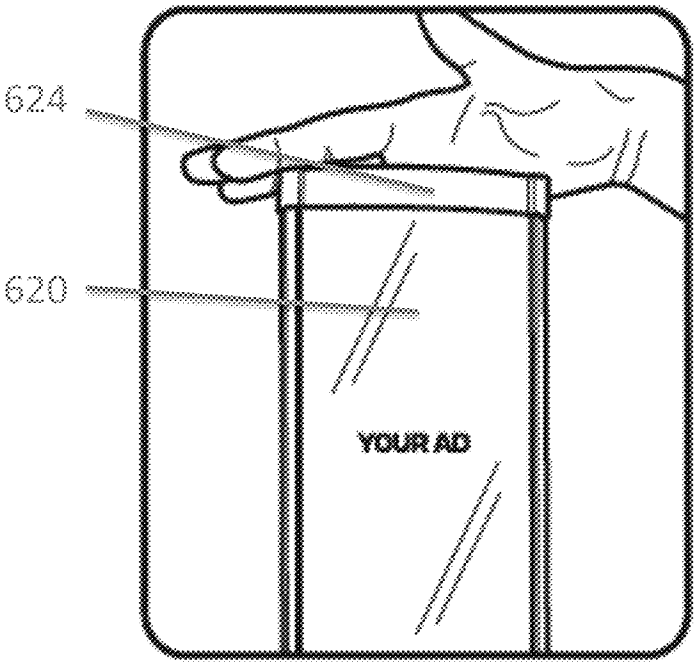
FIG. 34 is a depiction of the top end of the handle being covered with a top end cap.

Step 9. The person should cover the top end with the top end cap 624. See FIG. 34.

To change the display (advertisement), the person should 1) remove the top end cap 624; 2) pull out the old display (ad); 3) slide in a new display (ad); 4) replace the top end cap 624.

Embodiment 3: display assembly as a door handle using an inset handle and a flat surface for a sticker ad with no cover.

Figure 35:
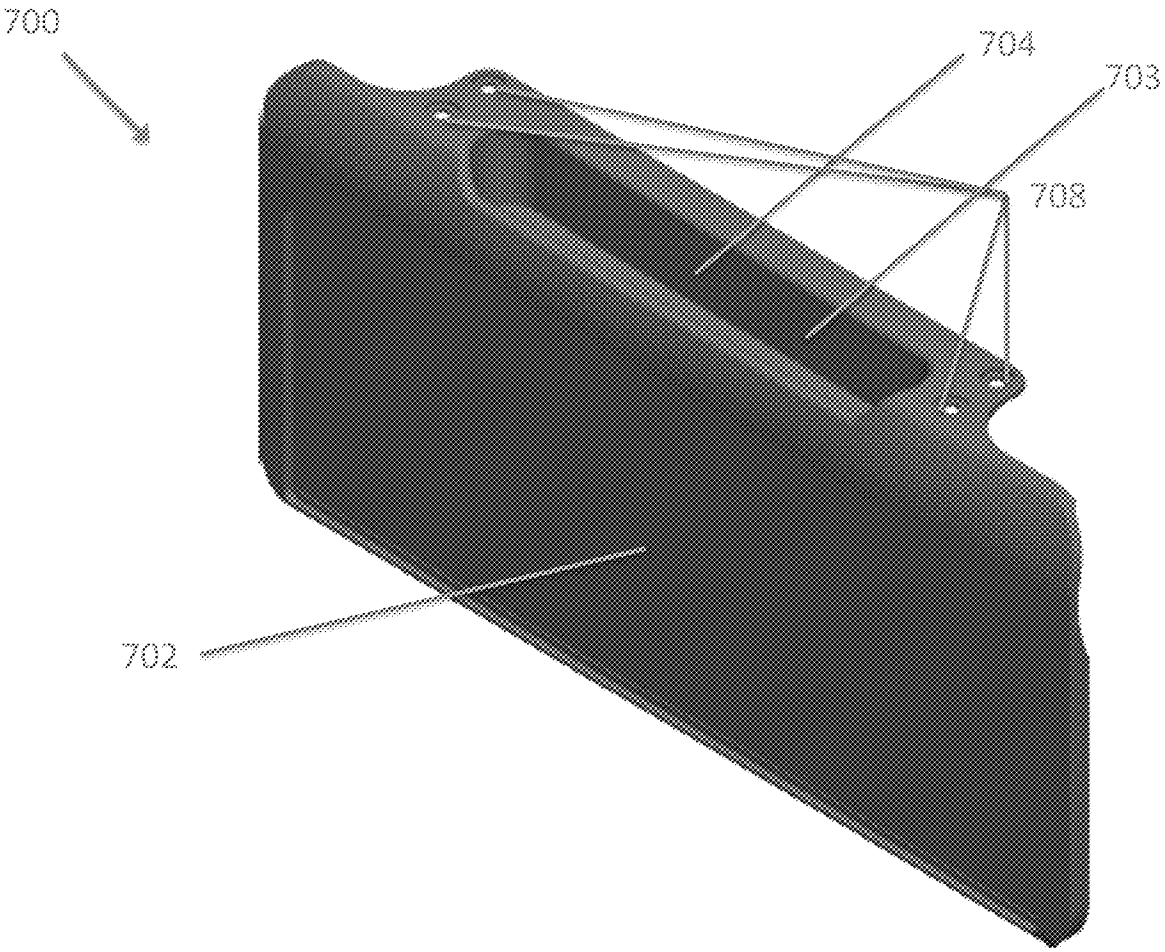
FIG. 35 is an isometric view of a contoured display assembly case as a door handle using an inset handle and a flat surface for a sticker ad with no cover.

FIG. 35 is a view of a contoured display assembly case as a door handle using an inset handle and a flat surface for a sticker ad with no cover. The display surface 702 is a recessed panel for holding advertising material, and does not contain a cover. The display assembly also has a canal handle 703, abutment 704 and four abutment apertures 708.

Figure 36:
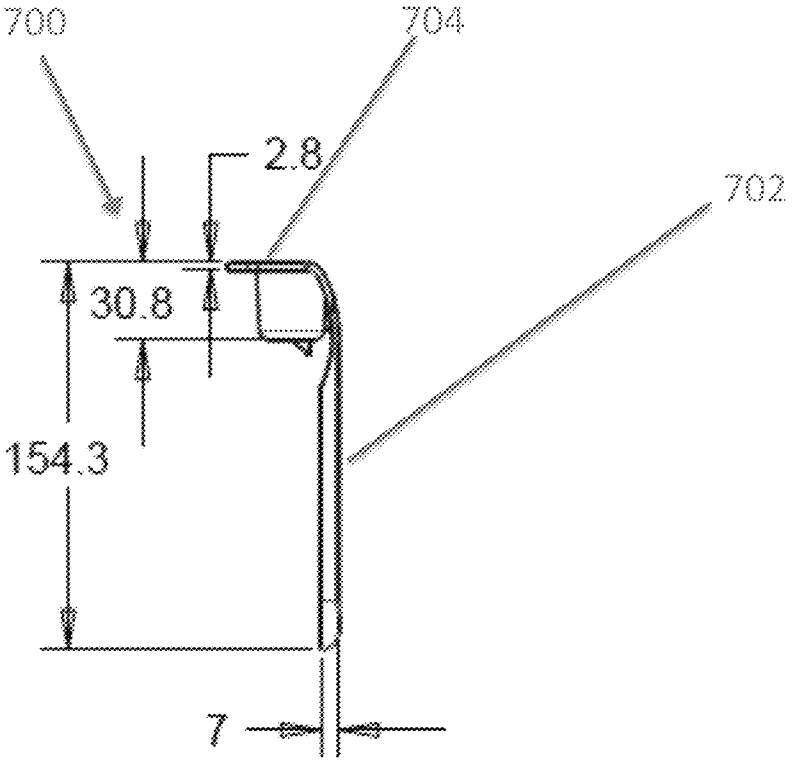
FIG. 36 is a drawn-to-scale top view of the contoured display assembly of FIG. 35.

FIG. 36 is a top view of a contoured display assembly case as a door handle. The thickness of the display surface 702 itself is approximately 7 mm, and the thickness of the abutment is approximately 2.8 mm. The distance from one end of the abutment to the distal end of the display surface is approximately 154.3 mm, while the distance from one end of the abutment to the proximal side of the display surface 702 is approximately 30.8 mm.

Figure 37:
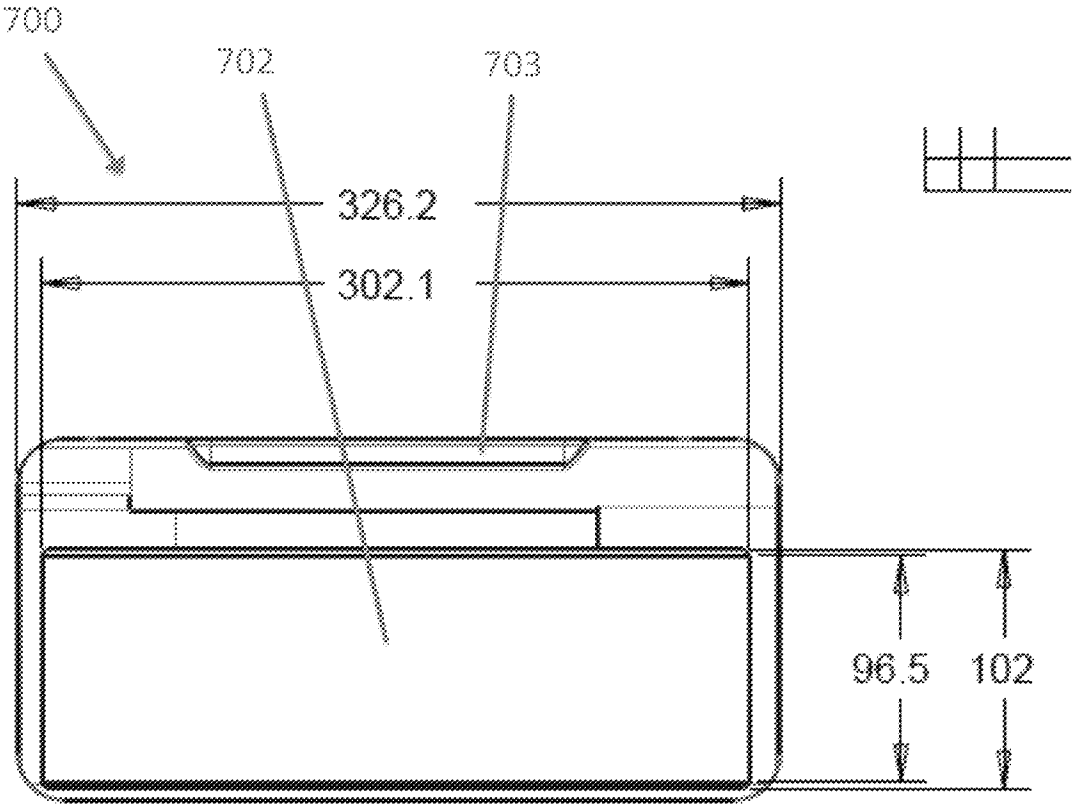
FIG. 37 is a drawn-to-scale front view of the contoured display assembly of FIG. 35.

FIG. 37 is a front view of the contoured display assembly case as a door handle. Shown is the handle canal 703. At the deepest part of the recessed inset on the display surface, the inset recess is shorter than it is at the shallowest level. At the deepest level, the width of the inset recess is approximately 96.5 mm, while at its shallowest level its width is approximately 102 mm. Furthermore, the entire length of the contoured display assembly case as a door handle is approximately 326.2 mm, while the length of the inset recess 702 is approximately 302.1 mm.

Figure 38:
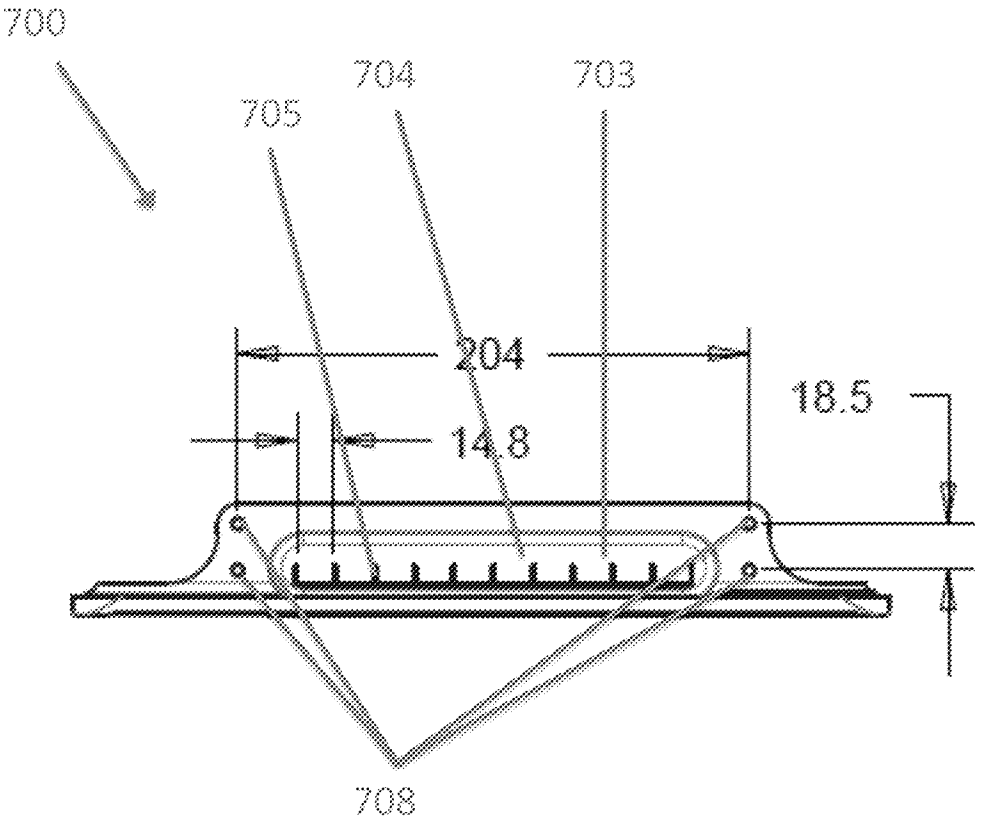
FIG. 38 is a drawn-to-scale side-rear view of the contoured display assembly of FIG. 35.

FIG. 38 is a side-rear view of the contoured display assembly case as a door handle. Since it is a view from the rear, the handle canal 703 protrudes from the abutment 704. Four abutment apertures 708 are shown; the distance between two abutment apertures on one side is approximately 18.5 mm, and the distance between abutment apertures on opposite sides is approximately 204 mm. On the handle canal 703 are several demarcations 705. The distance between each demarcation 705 is approximately 14.8 mm.

Figure 39:
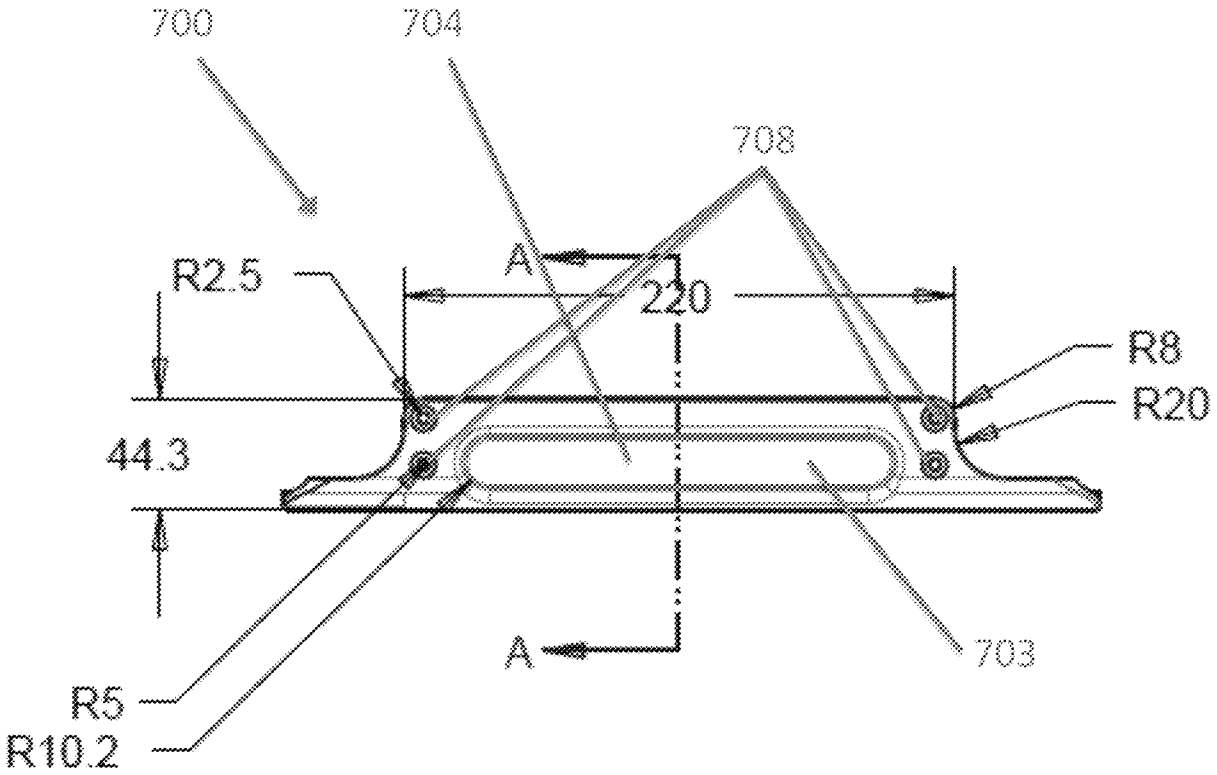
FIG. 39 is a drawn-to-scale side front view of the contoured display assembly of FIG. 35.

FIG. 39 is a side front view of the contoured display assembly case as a door handle. The width of the case from the end of the abutment to the face of the display surface is approximately 44.3 mm. The radius of each of the innermost portion of the abutment apertures is approximately 2.5 mm, while the radius of the outermost portion of the abutment apertures is approximately 5 mm. As can be seen in FIG. 39, the handle canal is shaped like a race track. The curved section of the track has a radius of approximately 10.2 mm. Finally, as the abutment is developed from the display surface, it first curves inward, and then outward to form the length of the abutment 704. The curvature of the inward portion has a radius of approximately 20 mm, while the curvature of the outward portion has a radius of approximately 8 mm.

Figure 40:
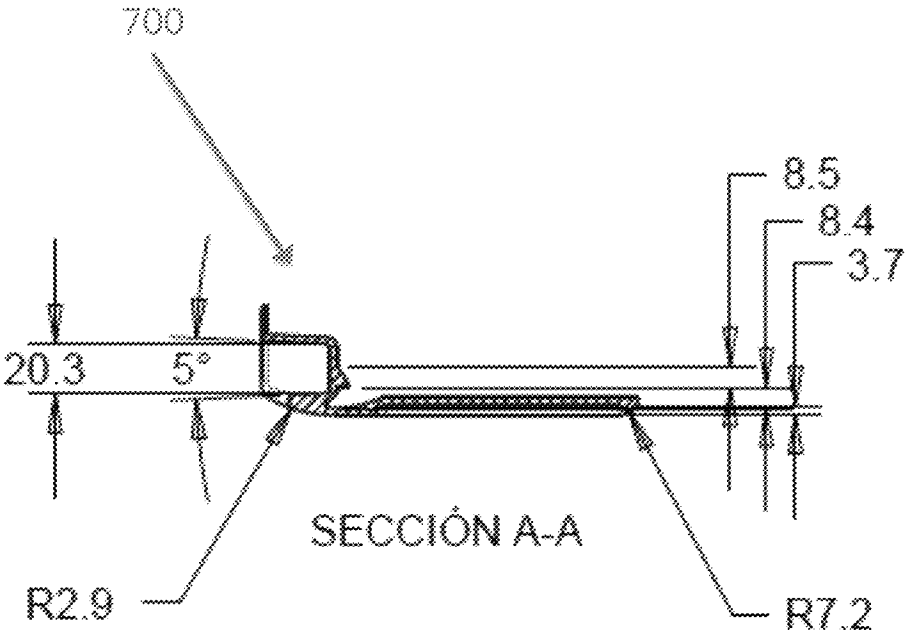
FIG. 40 is a drawn-to-scale bottom view of the contoured display assembly of FIG. 35.

FIG. 40 is a bottom view of the contoured display assembly case as a door handle. The width of the display surface on which the sticker ad goes is approximately 3.7 mm. The width of one half of the section of the display surface is approximately 8.4 mm. The width of the other half of the section of the display surface is approximately 8.5 mm. The width of the abutment 704 is approximately 20.3 mm. From one side of the abutment 704 that will abut the door, to the side of the abutment 704 that serves as the handle, there is a concave curvature with a radius of approximately 2.9 mm. Furthermore, the abutment 704 is able to sway approximately 5 degrees in either direction, in accordance with the door it abuts. The internal manufacture of the inset handle 702 has a radius of approximately 7.2 mm.

Figure 41:
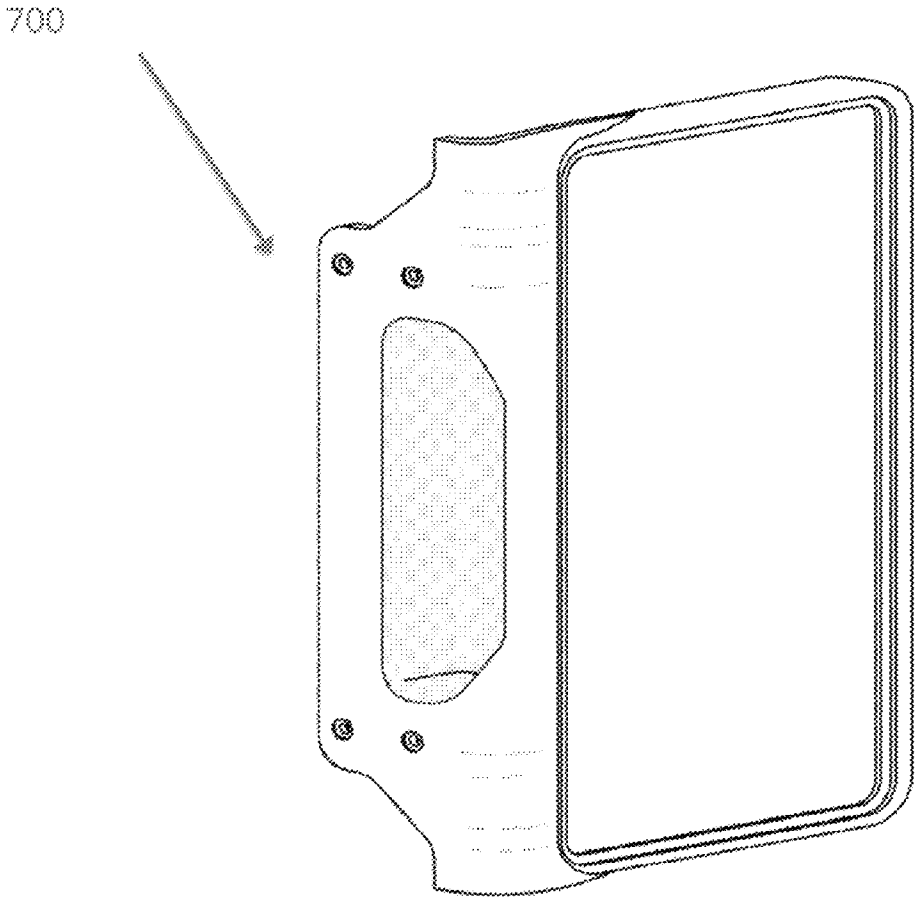
FIG. 41 is an isometric view of the front of a contoured display assembly case as a door handle using an inset handle and a flat surface for a sticker ad with no cover.
Figure 42:
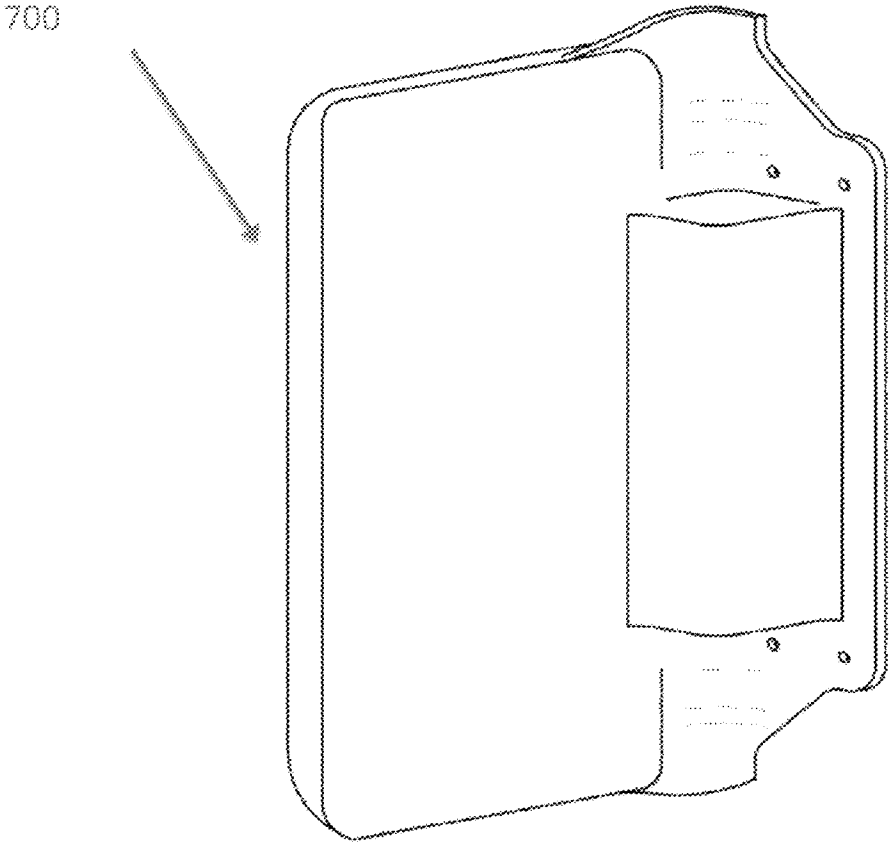
FIG. 42 is an isometric view of the rear of the contoured display assembly of FIG. 41.

FIG. 41 is an isometric view of the front of a contoured display case door handle accessory with a recessed panel for holding advertising material. This is similar to the view in FIG. 35. It is a display assembly as a door handle using a recessed inset handle 703 and a flat surface 702 for a sticker ad with no cover. It also comprises abutment 704, and four abutment apertures 708. FIG. 42 is an isometric view of the rear of the contoured display case door handle accessory, comprising the same items.

Figure 43:
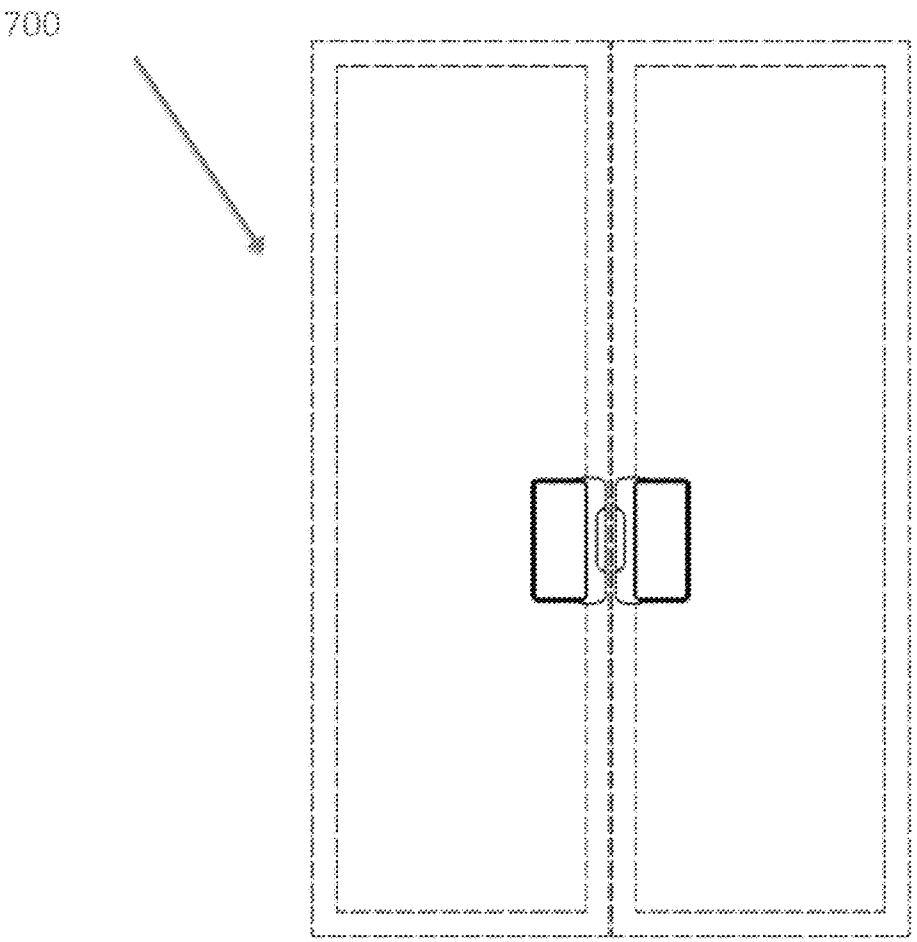
FIG. 43 is a front view of two display case doors shown in broken lines, on each of which is mounted a contoured display case door handle accessory as shown in FIGS. 41 and 42.

FIG. 43 is a front view of two display case doors shown in broken lines, on each of which is mounted a contoured display case door handle accessory as shown in FIGS. 41 and 42. Advertising material is able to be placed in the recessed panels 702 thereof.

Figure 44:
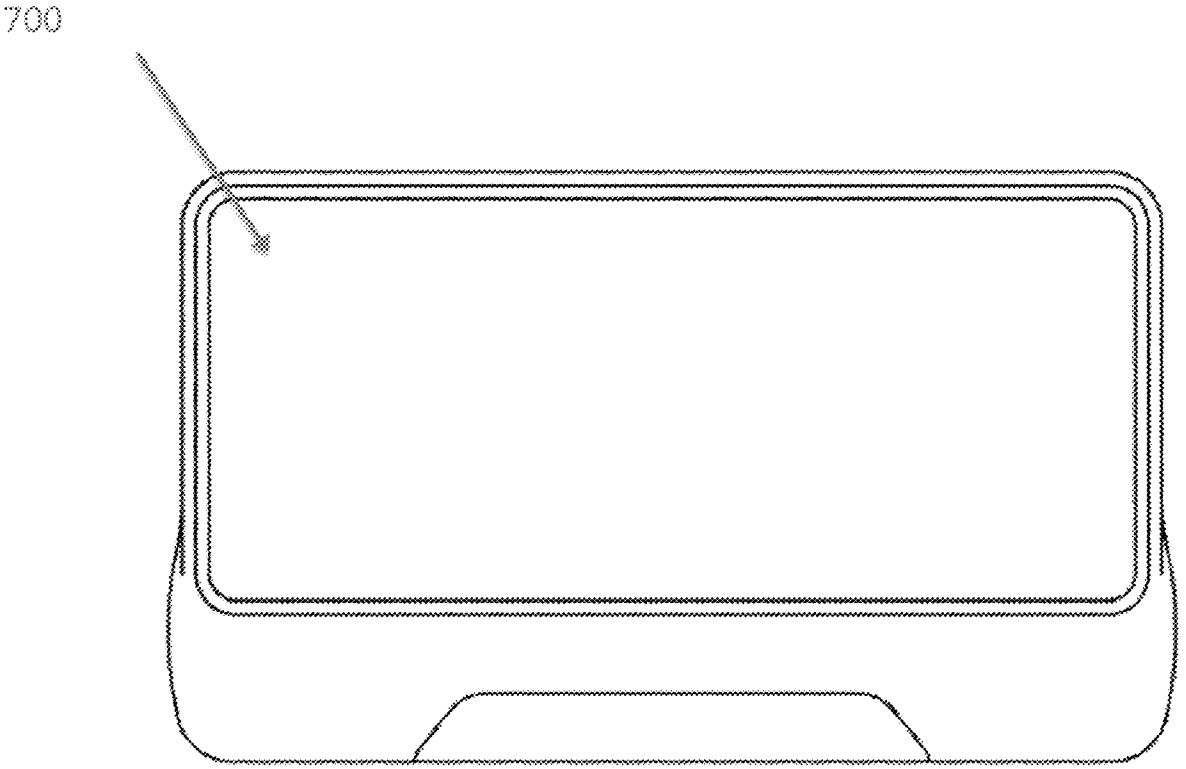
FIG. 44 is a front view of the display case door handle accessory shown in FIGS. 41 and 42.
Figure 45:
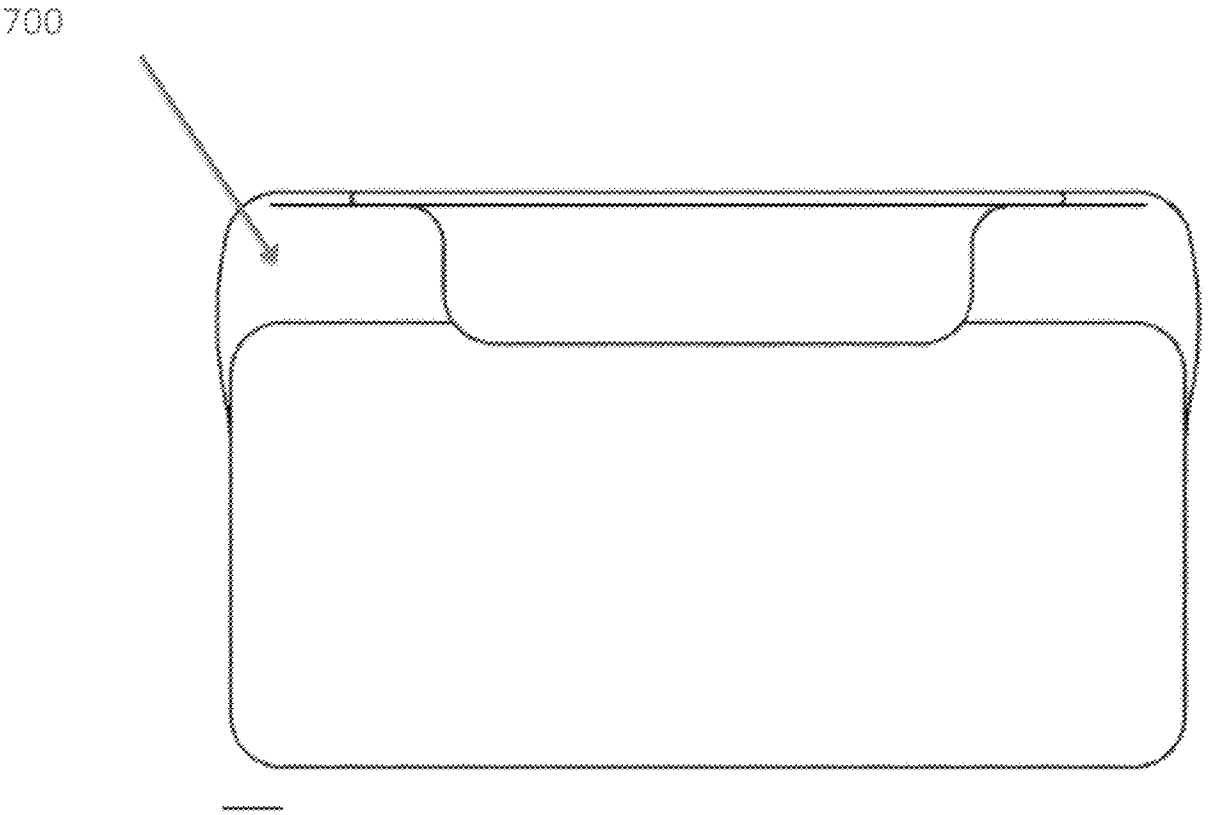
FIG. 45 is a rear view of the display case door handle accessory shown in FIGS. 41 and 42.
Figure 47:
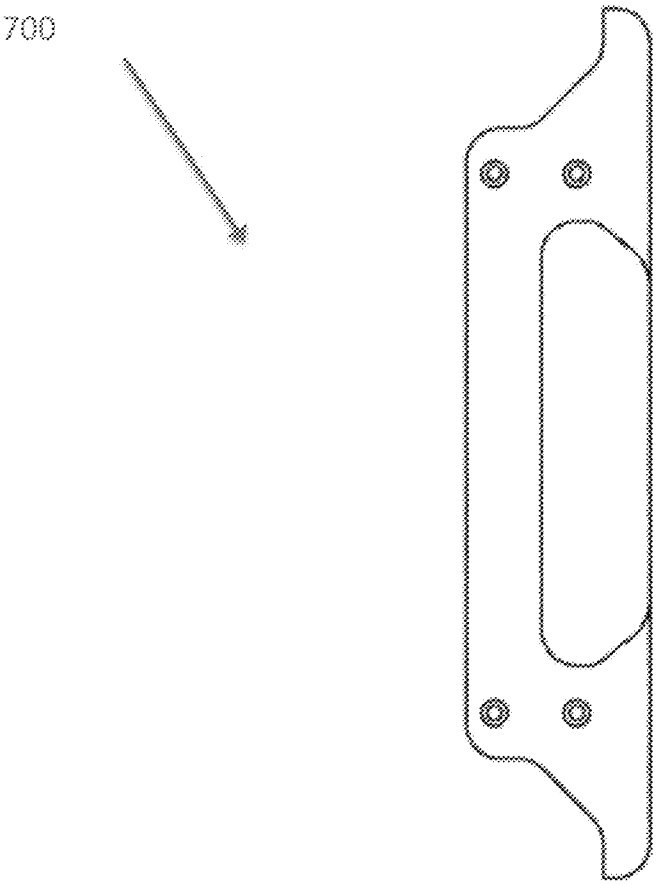
FIG. 47 is a view of the other side of the display case door handle accessory shown in FIGS. 41 and 42.
Figure 48:
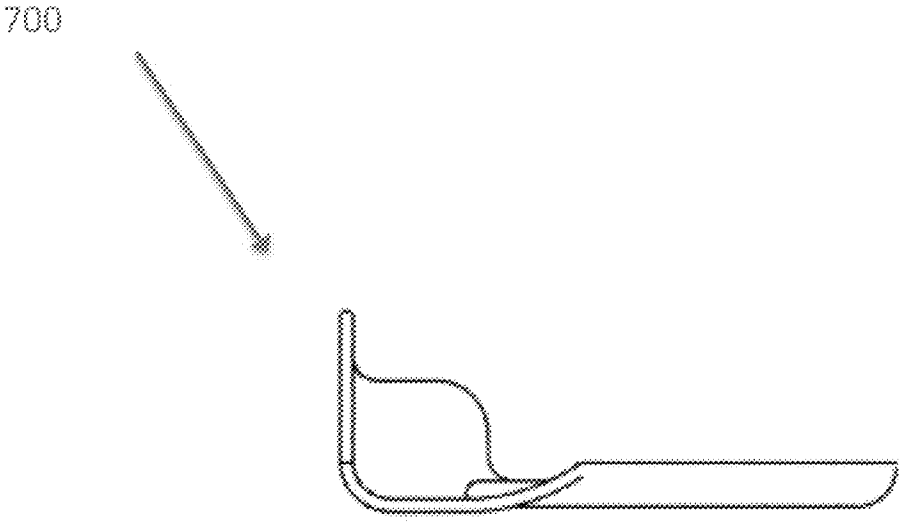
FIG. 48 is a top view of the display case door handle accessory shown in FIGS. 41 and 42.
Figure 49:
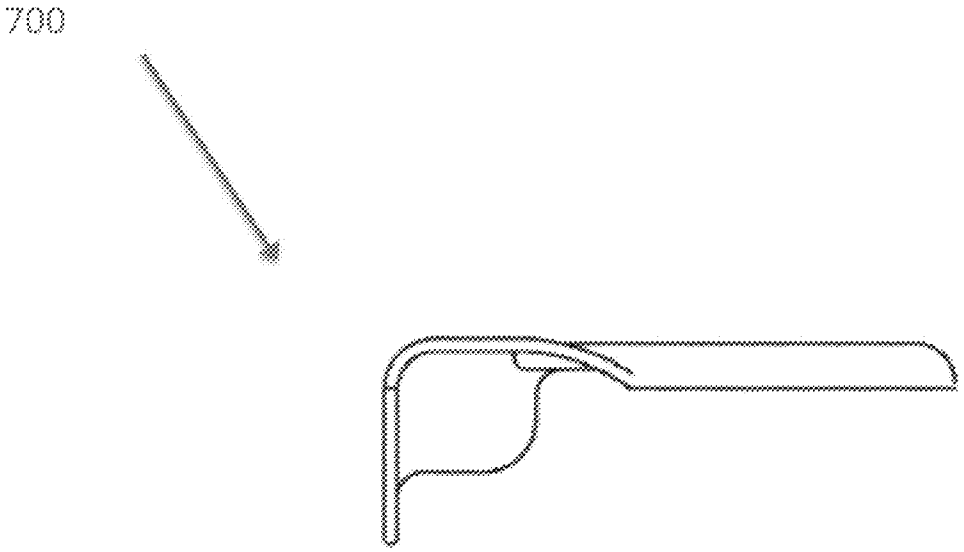
FIG. 49 is a bottom view of the display case door handle accessory shown in FIGS. 41 and 42.

FIGS. 44-49 are varying views of display assembly as a door handle using an inset handle and a flat surface for a sticker ad with no cover. FIG. 44 is a front view of the display case door handle accessory shown in FIGS. 41 and 42. FIG. 45 is a rear view of the display case door handle accessory shown in FIGS. 41 and 42. FIG. 46 is a view of one side of the display case door handle accessory shown in FIGS. 41 and 42. FIG. 47 is a view of the other side of the display case door handle accessory shown in FIGS. 41 and 42. FIG. 48 is a top view of the display case door handle accessory shown in FIGS. 41 and 42. FIG. 49 is a bottom view of the display case door handle accessory shown in FIGS. 41 and 42.

Figure 50:
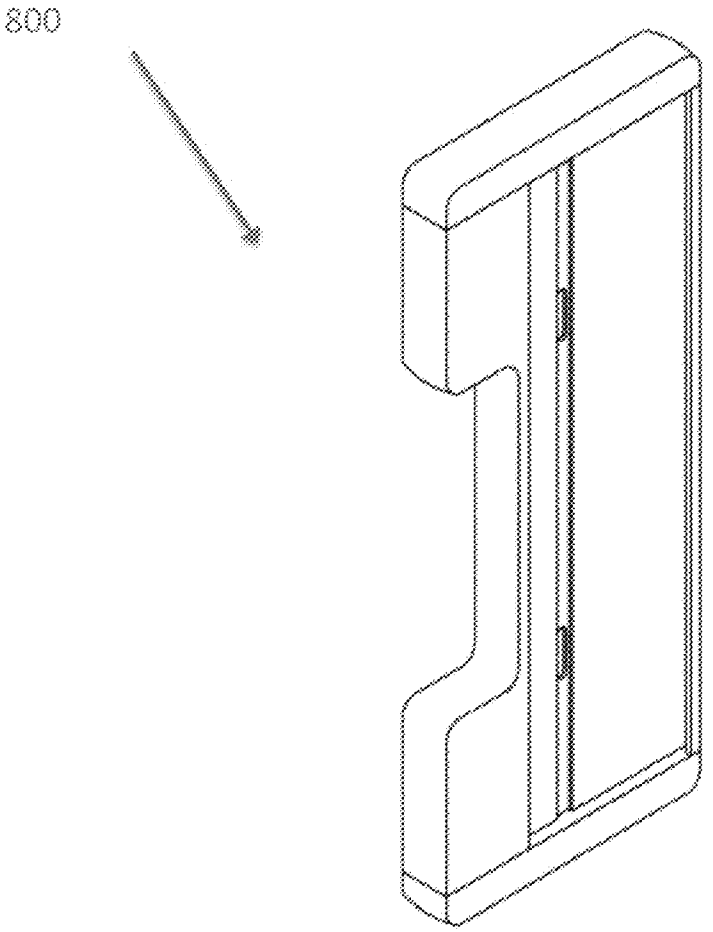
FIG. 50 is an isometric view of the front of an alternative embodiment of a display case door handle accessory with a recessed panel for holding advertising material.

Embodiment 4: display assembly as a door handle using an inset handle and a flat surface for a sticker ad with no cover FIG. 50 is an isometric view of the front of a display case door handle accessory with a recessed panel 802 for holding advertising material. It has an abutment 804 which abuts the door to which the display is attached. It also has a handle canal 803 which the person grips to open the storage unit that the display assembly as a door handle is attached to. Two circular fittings 814 are present to help secure the advertising material to the accessory. This embodiment structurally differs from the embodiment shown in FIGS. 35-49 in that it is thinner; and the abutment 804 does not curve around the door. The structure has an overall 'C' shape, and the person who grabs the accessory will grab onto the inner portion of the 'C' while viewing the advertising material.

Figure 51:
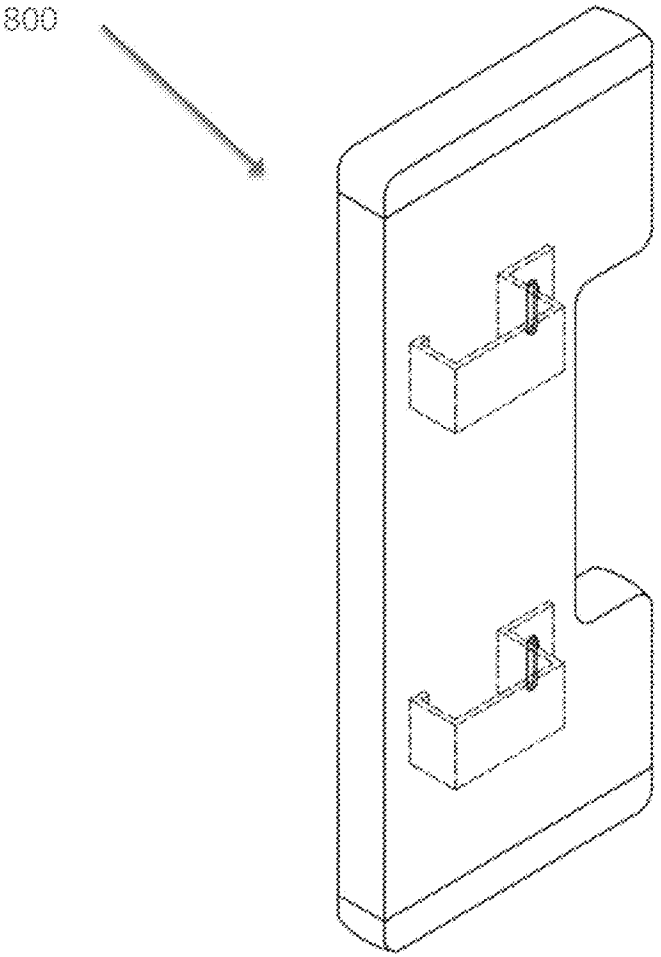
FIG. 51 is an isometric view of the rear of the display case door handle accessory shown in FIG. 1, with broken lines showing brackets for mounting the display case door handle accessory.

FIG. 51 is an isometric view of the rear of the display case door handle accessory shown in FIG. 1, with broken lines showing brackets 812 for mounting the display case door handle accessory on a display case door handle. The brackets shown in FIG. 51 have a substantially rectilinear loop surface.

Figure 52:
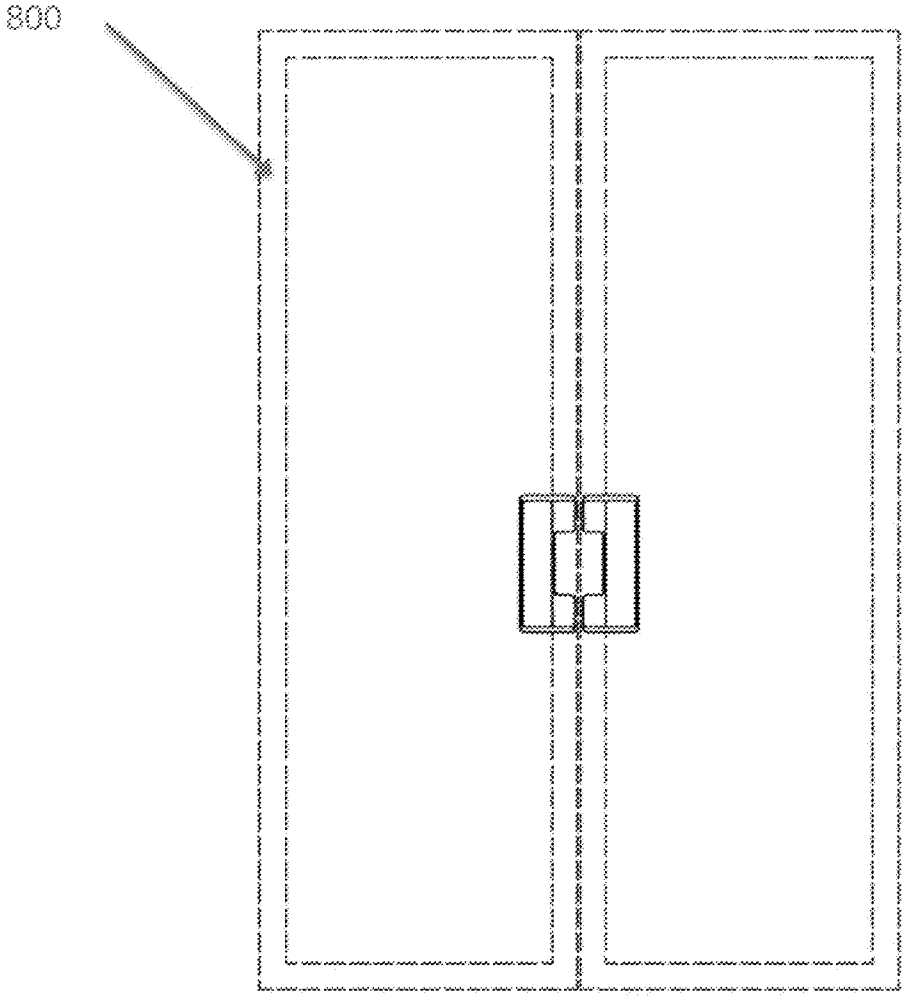
FIG. 52 is a front view of two display case doors shown in broken lines, on each of which is mounted a display case door handle accessory as shown in FIGS. 50 and 51 with a place for advertising material in the recessed panels thereof.

FIG. 52 is a front view of two display case doors shown in broken lines, on each of which is mounted a display case door handle accessory as shown in FIGS. 50 and 51 with advertising material in the recessed panels thereof.

Figure 53:
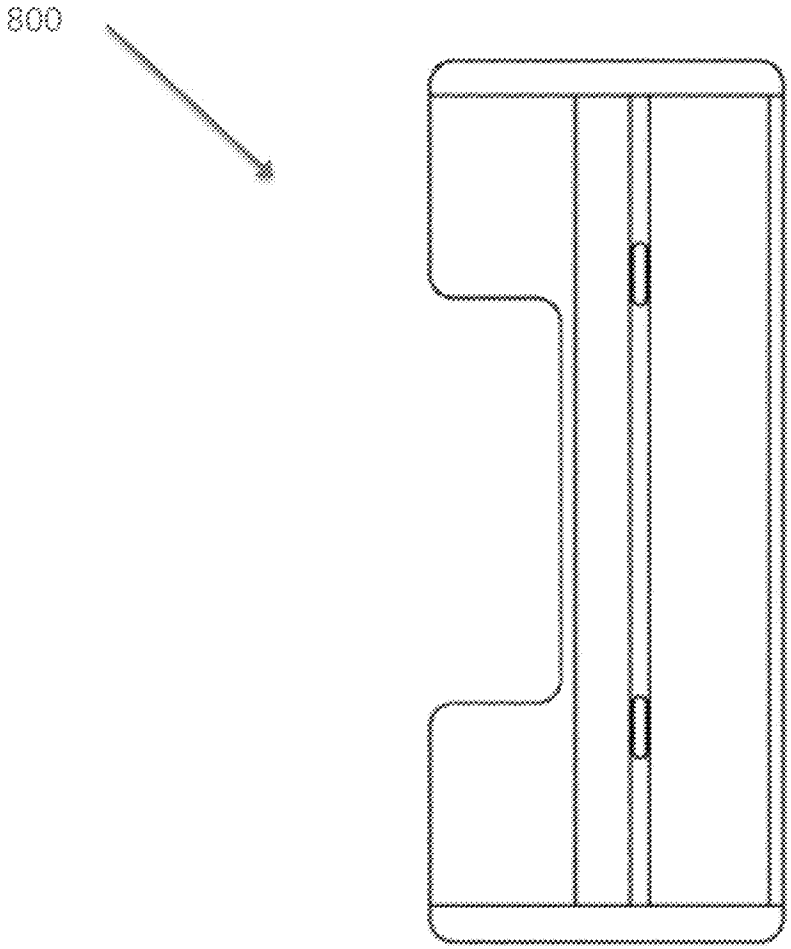
FIG. 53 is a front view of the display case door handle accessory shown in FIGS. 50 and 51.
Figure 54:
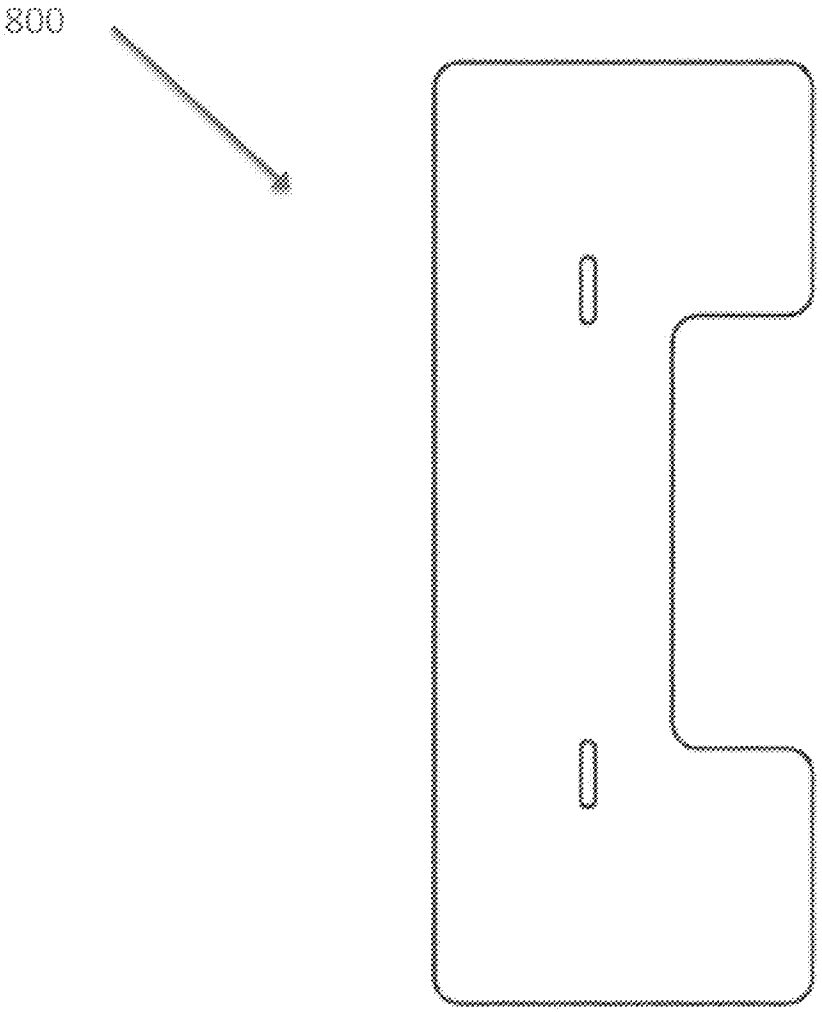
FIG. 54 is a rear view of the display case door handle accessory shown in FIGS. 50 and 51.
Figure 55:
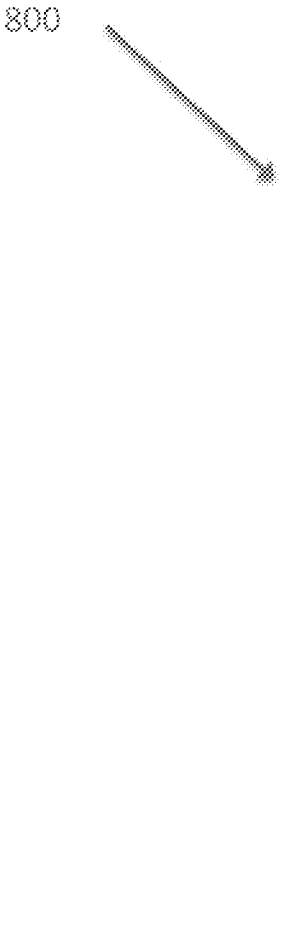
FIG. 55 is a view of one side of the display case door handle accessory shown in FIGS. 50 and 51.
Figure 56:
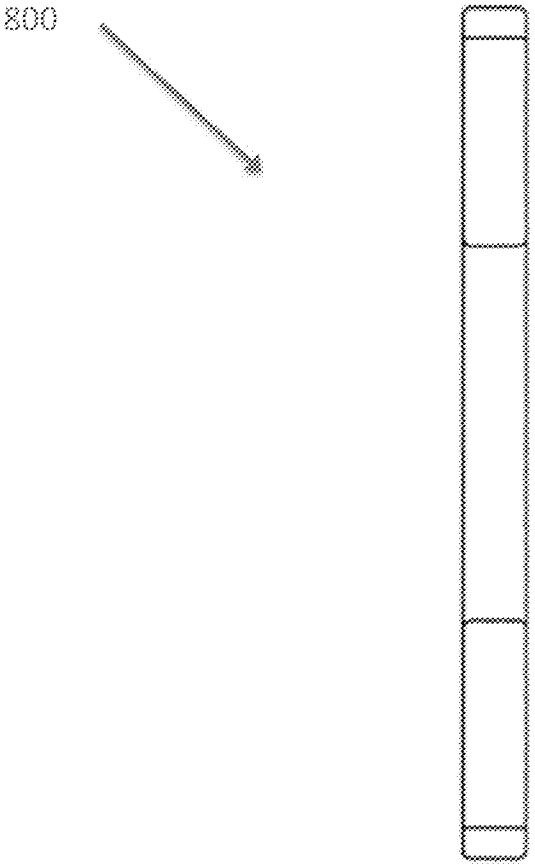
FIG. 56 is a view of the other side of the display case door handle accessory shown in FIGS. 50 and 51.
Figure 57:
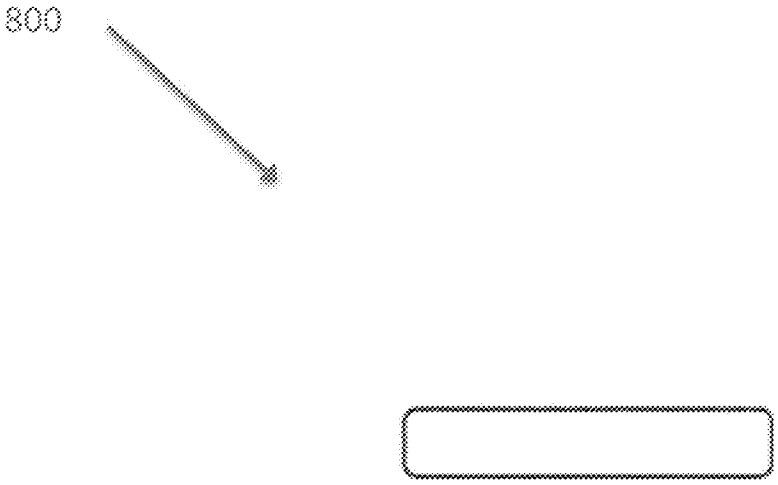
FIG. 57 is a top view of the display case door handle accessory shown in FIGS. 50 and 51.
Figure 58:
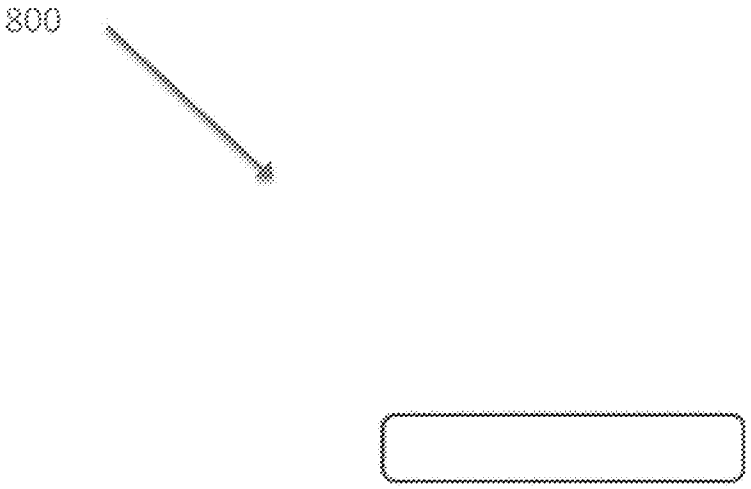
FIG. 58 is a bottom view of the display case door handle accessory shown in FIGS. 50 and 51.

FIGS. 53-58 are various views of embodiment 4 of the display case door handle accessory with a recessed panel 802. FIG. 53 is a front view of the display case door handle accessory shown in FIGS. 50 and 51. FIG. 54 is a rear view of the display case door handle accessory shown in FIGS. 50 and 51. FIG. 55 is a view of one side of the display case door handle accessory shown in FIGS. 50 and 51. FIG. 56 is a view of the other side of the display case door handle accessory shown in FIGS. 50 and 51. FIG. 57 is a top view of the display case door handle accessory shown in FIGS. 50 and 51. FIG. 58 is a bottom view of the display case door handle accessory shown in FIGS. 50 and 51.

While the above specification and examples provide a description of the invention, many embodiments of the invention can be made without departing from the spirit and scope of the invention. It is to be understood that the foregoing embodiments are provided as illustrative only, and does not limit or define the scope of the invention. Various other embodiments are also within the scope of the claims.

What is claimed is:

1. A door handle assembly that interoperates with a storage unit's electrical system comprising:

an outrigger for securing a handle to a door, the outrigger comprising:

a door abutment having opposing apertures;

a handle canal with room for a person's hand to grip the handle; and two display abutments coupled to the door abutment that telescope away from the door abutment, each display abutment comprising display abutment apertures;

a display accessory panel coupled to the display abutments via the display abutment apertures, the display accessory panel having a surface comprising opposing lip flanges for receiving a display advertisement insert; and at least one wire in electrical communication with the storage unit's electrical system that passes through the display assembly to provide power to the display assembly.

2. The door handle assembly of claim 1, wherein the handle canal comprises demarcations spaced apart at a fixed distance across its length on its rear side.

3. The door handle assembly of claim 1, wherein each display abutment comprises recesses to provide room to abut the display accessory panel.

4. The door handle assembly of claim 1, wherein the display abutments fan out, increasing in width along the direction moving towards the door abutment.

5. The door handle assembly of claim 1, wherein each display abutment comprises two apertures.

6. The door handle assembly of claim 1, wherein the door abutment comprises two apertures on each opposing side.

7. A door handle assembly comprising:

an outrigger for securing a handle to a door, the outrigger comprising:

a door abutment having opposing apertures;

a handle canal with room for a person's hand to grip the handle; and two display abutments coupled to the door abutment that telescope away; from the door abutment, each display abutment comprising display abutment apertures; and a display accessory panel coupled to the display abutments via the display abutment apertures, the display accessory panel having a surface comprising opposing lip flanges for receiving a display advertisement insert.

8. The door handle assembly of claim 7, wherein the handle canal comprises demarcations spaced apart at a fixed distance across its length on its rear side.

9. The door handle assembly of claim 7, wherein each display abutment comprises recesses to provide room to abut the display accessory panel.

10. The door handle assembly of claim 7, wherein the display abutments fan out, increasing in width along the direction moving towards the door abutment.

11. The door handle assembly of claim 7, wherein each display abutment comprises two apertures.

12. The door handle assembly of claim 7, wherein the door abutment comprises two apertures on each opposing side.

* * * * *